United States Patent [19]

Miller

[11] Patent Number: 4,556,032

[45] Date of Patent: Dec. 3, 1985

[54] ADAPTER MEANS FOR CREATING AN OPEN LOOP MANUALLY ADJUSTABLE APPARATUS AND SYSTEM FOR SELECTIVELY CONTROLLING THE AIR-FUEL RATIO SUPPLIED TO A COMBUSTION ENGINE

[75] Inventor: Robert J. Miller, Warren, Mich.

[73] Assignee: Colt Industries Operating Corp, New York, N.Y.

[21] Appl. No.: 568,393

[22] Filed: Jan. 5, 1984

[51] Int. Cl.[4] ..... F02M 7/12

[52] U.S. Cl. ..... 123/438; 123/437; 261/34 R; 261/50 R; 261/70

[58] Field of Search ..... 123/438, 437; 261/34 R, 261/70, 50 R

[56] References Cited

U.S. PATENT DOCUMENTS

| | | | |
|---|---|---|---|
| 3,372,912 | 3/1968 | Benmore | 261/70 |
| 4,003,968 | 1/1977 | Rickert | 261/34 R |
| 4,426,979 | 1/1984 | Tung | 123/438 |
| 4,434,762 | 3/1984 | McCabe | 261/50 R |

FOREIGN PATENT DOCUMENTS

| | | | |
|---|---|---|---|
| 57-2451 | 1/1982 | Japan | 123/438 |

*Primary Examiner*—Andrew M. Dolinar
*Attorney, Agent, or Firm*—Walter Potoroka, Sr.

[57] ABSTRACT

A vehicle has a combustion engine, ground-engaging drive wheels, a power transmission for conveying power from the engine to the wheels, an induction passage for supplying motive fluid to the engine, a source of fuel, adaptive structure defining a fuel metering system communicating generally between the source of fuel and the induction passage, the adaptive structure having a valving arrangement in the fuel metering system effective to controllably alter the rate of metered fuel flow through the fuel metering system, and a manually controlled adjustment operatively connected to the valving arrangement, the manually controlled adjustment being effective to selectively control the valving arrangement in order to thereby selectively alter the rate of metered fuel flow to the engine.

20 Claims, 12 Drawing Figures

ADAPTER MEANS FOR CREATING AN OPEN LOOP MANUALLY ADJUSTABLE APPARATUS AND SYSTEM FOR SELECTIVELY CONTROLLING THE AIR-FUEL RATIO SUPPLIED TO A COMBUSTION ENGINE

FIELD OF THE INVENTION

This invention relates generally to fuel metering systems for use with combustion engines and more particularly to a fuel metering system, wherein the rate of flow of metered fuel can be manually selected during any condition of engine operation, which can be added to carburetor structures as adaptive means thereto.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of governments to be insufficient. Further, such levels of government have also imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, the available technology employable in attempting to attain increases in engine fuel economy is, generally, contrary to that technology employable in attempting to meet the governmentally imposed standards on exhaust emissions.

For example, the prior art, in trying to meet the standards for $NO_x$ emissions, has employed a system of exhaust gas recirculation whereby at least a portion of the exhaust gas is re-introduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for burning.

The prior art has also proposed the use of fuel metering means which are effective for metering a relatively overly-rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust, which, in turn, requires the supplying of additional oxygen, as by an associated air pump, to such engine exhaust in order to complete the oxidation of the CO and HC prior to its delivery into the atmosphere.

The prior art has also heretofore proposed retarding of the engine ignition timing as a further means for reducing the creation of $NO_x$. Also, lower engine compression ratios have been employed in order to lower the resulting combustion temperature within the engine combustion chamber and thereby reduce the creation of $NO_x$.

The prior art has also proposed the use of fuel metering injection means instead of the usually-employed carbureting apparatus and, under superatmospheric pressure, injecting the fuel into either the engine intake manifold or directly into the cylinders of a piston type internal combustion engine. Such fuel injection system, besides being costly, have not proven to be generally successful in that the system is required to provide metered fuel flow over a very wide range of metered fuel flows. Generally, those injection system which are very accurate at one end of the required range of metered fuel flows, are relatively inaccurate at the opposite end of that same range of metered fuel flows. Also, those injection systems which are made to be accurate in the mid-portion of the required range of metered fuel flows are usually relatively inaccurate at both ends of that same range. The use of feedback means for altering the metering characteristics of a particular fuel injection system have not solved the problem because the problem usually is intertwined with such factors as: effective aperture area of the injector nozzle; comparative movement required by the associated nozzle pintle or valving member; inertia of the nozzle valving member and nozzle "cracking" pressure (that being the pressure at which the nozzle opens). As should be apparent, the smaller the rate of metered fuel flow desired, the greater becomes the influence of such factors thereon.

It is anticipated that the said various levels of government will establish even more stringent exhaust emission limits and even higher standards of fuel economy.

The prior art, in view of such anticipated requirements with respect to $NO_x$, has suggested the employment of a "three-way" catalyst, in a single bed, within the stream of exhaust gases as a means of attaining such anticipated exhaust emission limits. Generally, a "three-way" catalyst (as opposed to the "two-way" catalyst system also well known in the prior art) is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively, but the oxidation of CO will be incomplete. On the other hand, if the fuel metering is too lean, the CO will be effectively oxidized but the reduction of $NO_x$ will be incomplete. Obviously, in order to make such a "three-way" catalyst system operative, it is necessary to have very accurate control over the fuel metering function of associated fuel metering supply means feeding the engine. As hereinafter described, the prior art has suggested the use of fuel injection means with associated feedback means (responsive to selected indicia of engine operating conditions and parameters) intended to continuously alter or modify the metering charactertistics of the fuel injection means. However, at least to the extent hereinafter indicated, such fuel injection systems have not proven to be successful.

It has also heretofore been proposed to employ fuel metering means, of a carbureting type, with closed loop feedback means responsive to the presence of selected constituents comprising the engine exhaust gases. Such closed loop feedback means were employed to modify the action of a main metering rod of a main fuel metering system of a carburetor. However, tests and experience have indicated that such a prior art carburetor with such a related closed loop feedback means could not provide the degree of accuracy required in the metering of fuel to an associated engine as to assure meeting, for example, the said anticipated emission and fuel economy standards.

Also, heretofore, the prior art has proposed an arrangement whereby a carburetor, having an induction passage therethrough with a venturi therein and a main fuel discharge nozzle situated generally within the venturi, has a main fuel metering system communicating generally between a fuel reservoir and the main fuel discharge nozzle along with an idle fuel metering system communicating generally between a fuel reservoir and said induction passage at a location generally in close proximity to an edge of a variably openable throttle valve situated in the induction passage downstream of the main fuel discharge nozzle. Modulating valving means are provided to controllably alter the rate of metered fuel flow through each of the main and idle fuel metering systems in response to control signals generated as a consequence of selected indicia of engine operation. Such indicia comprised engine exhaust gas constituent responsive means for sensing the relative percentage of selected exhaust gas constituents and producing control signals in response thereto. Also, electronic computer means are usually provided for processing all of the control signals and, in response thereto, producing an output signal or signals effective for controlling the modulating valving means.

In the main, such prior art systems can not be readily adapted to all engines and vehicles especially where such engines and/or vehicles were manufactured prior to the commercial availability of such prior art fuel metering systems.

Accordingly, the invention as herein disclosed is primarily directed to the provision of a fuel metering system which can be readily adapted to carburetors constructed in accordance with the prior art and already being employed on vehicle engines and which, further, enables the vehicle operator a certain degree of control thereover in order to be able to select, for example, the rate of metered fuel flow to the engine in order to obtain maximum fuel economy for whatever engine demands are being then experienced.

SUMMARY OF THE INVENTION

According to the invention adapter means for creating an open loop manually adjustable apparatus and system for selectively controlling the air-fuel ratio supplied to a vehicular combustion engine wherein said vehicle has ground-engaging drive wheel means, power transmission means for conveying power from the engine to said wheel means and a source of fuel, and wherein said engine is provided with induction passage means for supplying motive fluid to said engine, said adapter means comprising adaptive structure defining a fuel metering system communicating generally between said source of fuel and the induction passage, the adaptive structure having a valving arrangement in the fuel metering system effective to controllably alter the rate of metered fuel flow through the fuel metering system, and a manually controlled adjustment operatively connected to the valving arrangement, the manually controlled adjustment being effective to selectively control the valving arrangement in order to therby selectively alter the rate of metered fuel flow to the engine.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
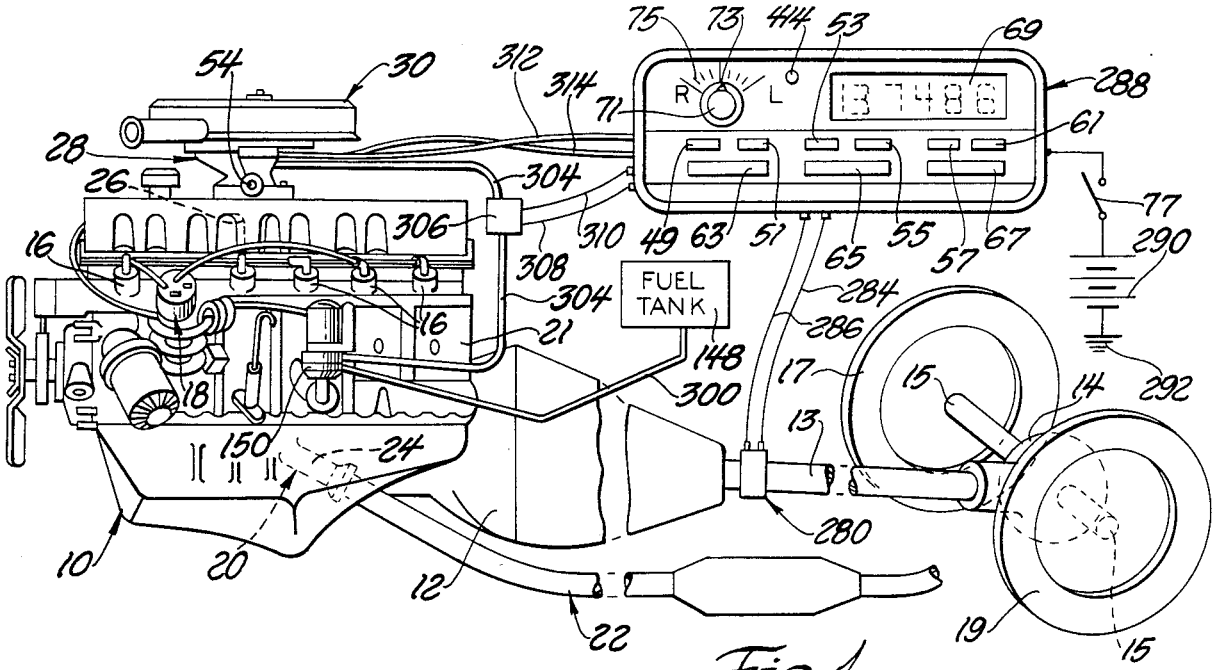
FIG. 1 illustrates, in side elevational view, a fragmentary portion of a vehicle equipped with a vehicular combustion engine employing a carbureting apparatus and related control system employing teachings of the invention.

Referring now in greater detail to the drawings, FIG. 1 illustrates a combustion engine 10 used to propell an associated vehicle as through power output transmission means 12, drive or propeller shaft 13, differential gearing assembly 14, drive axle means 15 and ground engaging drive wheels 17 and 19. The engine 10 may, for example, be of the internal combustion type employing, as is generally well known in the art, a plurality of power piston means therein. As generally depicted, the engine assembly 10 is shown as being comprised of an engine block 21 containing, among other things, a plurality of cylinders respectively reciprocatingly receiving said power pistons therein. A plurality of spark or ignition plugs 16, as for example one for each cylinder, are carried by the engine block and respectively electrically connected to an ignition distributor assembly or system 18 operated in timed relationship to engine operation.

As is generally well known in the art, each cylinder containing a power piston has exhaust aperture or port means and such exhaust port means communicate as with an associated exhaust manifold which is fragmentarily illustrated in hidden line at 20. Exhaust conduit means 22 is shown operatively connected to the discharge end 24 of exhaust manifold 20 and leading as to the rear of the associated vehicle for the discharging of exhaust gases to the atmosphere.

Further, as is also generally well known in the art, each cylinder which contains a power piston also has inlet aperture means or port means and such inlet aperture means communicate as with an associated inlet manifold which is fragmentarily illustrated in hidden line at 26.

As generally depicted, a carbureting type fuel metering apparatus 28, employing teachings of the invention, is situated atop a cooperating portion of the inlet or intake manifold means 26. A suitable inlet air cleaner assembly 30 may be situated atop the carburetor assembly 28 to filter the air prior to its entrance into the inlet of the carburetor assembly 28.

Figure 2:
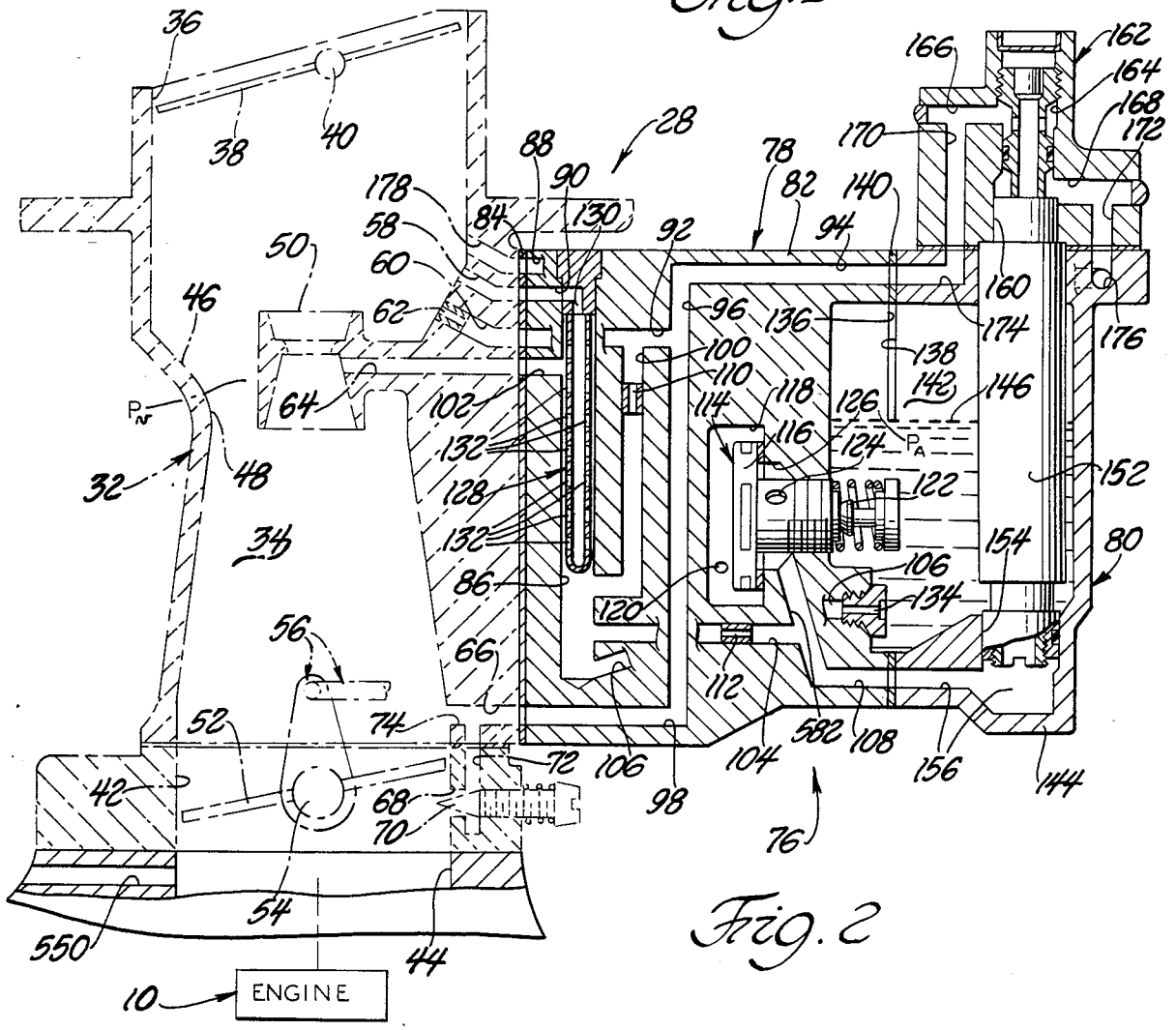
FIG. 2 is an enlarged view, in cross-section, of the carbureting apparatus of FIG. 1.

In FIG. 2, portions are illustrated in phantom line as to, generally, pictorially depict, for example, a prior existing carburetor structure, or a portion thereof, to which the adaptive structure of the invention has been operatively secured.

FIG. 2 illustrates the carburetor assembly 28, employing teachings of the invention, as comprising prior existing main carburetor body means 32 having induction passage means 34 formed therethrough with an upper inlet end 36, in which generally is situated a variably openable choke valve 38 carried as by a pivotal choke shaft 40, and a discharge end 42 communicating as with the inlet 44 of engine intake manifold 26. A venturi section 46, having a venturi throat 48, is provided within the induction passage means 34 generally between the inlet 36 and outlet or discharge end 42. A main metering fuel discharge nozzle 50, situated generally within the throat 48 of venturi section 46, serves to discharge fuel, as is metered by the main metering system, into the induction passage means 34.

A variably openable throttle valve 52, carried as by a rotatable throttle shaft 54, serves to variably control the discharge and flow of combustible (fuel-air) mixtures into the inlet 44 of intake manifold 26. Suitable throttle control linkage means, as generally depicted at 56, is provided and operatively connected to throttle shaft 54 in order to affect throttle positioning in response to operator demand.

In the prior existing carburetor body means 32, various passage and/or conduit means may have been provided. For example, conduit means 58 may have been provided for the communication of bleed air to the related main fuel metering means previously associated with the body means 32. Conduit means 60 and calibrated restriction means 62 may have been provided for supplying idle bleed air to the related idle fuel metering means previously associated with the carburetor body means 32. Conduit means 64 would have been provided for supplying metered main fuel to the discharge nozzle means 50 as from the related main fuel metering means previously associated with the carburetor body means 32. Conduit means 66 would have been provided for conveying idle fuel flow, from the related idle fuel metering system previously associated with the carburetor body means 32, to an idle fuel discharge port 68, the effective flow area of which might be selectively attained as by an adjustable needle-like valve member 70, as via conduit means 72, and to the off-idle or transfer discharge port means 74.

The adaptive structure 76 is illustrated as comprising, what may be referred to as, separable metering body or housing means 78 and fuel bowl or reservoir defining means 80.

The metering body means 78 is preferably comprised of a block or body 82 which is suitably detachably secured (as by suitable fastener means not shown) to the prior existing carburetor body means 32 in a manner, preferably, as to contain, therebetween, suitable gasket or sealing means 84.

Metering body means 82 has formed therein or otherwise defines a main well 86 along with a plurality of conduit or @Öpassage sections 88, 90, 92, 94, 96, 98, 100, 102, 104, 106 and 108. As generally depicted, conduit sections or portions 100 and 104 may comprise calibrated passage or restriction means 110 and 112, respectively. Preferably, suitable power valve means 114 is provided and carried as to have a first control end 116 thereof situated as in related chamber or cavity means 118 which, in turn, is in communication with a source/550 of engine or intake manifold vacuum, as via conduit means 120, to thereby result in the related valving member 122 opening and permiting additional rates of fuel flow therepast and through orifice means 124 into annulus 126 and into passage or conduit section 108 upon the engine experiencing a preselected engine load. The operation and various forms of power valve assemblies are well known in the art and the practice of the invention is not limited to the use of a particular embodiment of power valve assembly, if any.

The main well 86 preferably contains a main well tube 128 which, as at its upper end, is preferably provided with calibrated main air bleed passage or restriction means 130 and, further, is provided with a plurality of generally radially directed apertures 132 formed through the wall thereof as to provide for communication as between the interior of the tube 128 and the portion of the well 86 generally radially surrounding the tube 128. A main fuel calibrated restriction means 134 is situated generally upstream of well 86 as, for example, in conduit means 106, in order to meter the rate of fuel flow from the fuel reservoir to main well 86.

In the preferred embodiment, the metering block or body means 82 is provided as with a generally circumscribing seating surface 136 against which a cooperating seating surface 138 of structure 80 is operatively secured, preferably, in a manner as to thereby contain gasket or sealing means 140 therebetween. When assembled as generally depicted in FIG. 2, a fuel bowl chamber or reservoir 142 is defined as by the space generally contained by metering block or body means 82 and housing or body portion 144 of structure 80. Fuel 146 is supplied to the fuel bowl chamber 142, as from the vehicular fuel tank 148 and fuel pump 150 (FIG. 1), through suitable fuel reservoir inlet valve means (not shown but well known in the art) which may be controlled as by a float mechanism within the fuel bowl chamber 142 (not shown but also well known in the art). Further, as is generally well known in the art, the interior of fuel reservoir chamber 142 is preferably vented to a source of generally ambient air as by any suitable vent-like passage means (not shown).

Generally, when the engine is running, the intake stroke of each power piston causes air flow through the induction passage 34 and venturi throat 48. The air thusly flowing through the venturi throat 48 creates a low pressure commonly referred to as a venturi vacuum. The magnitude of such venturi vacuum is determined primarily by the velocity of the air flowing through the venturi and, of course, such velocity is determined by the speed and power output of the engine. The difference between the pressure in the venturi and the air pressure within fuel reservoir chamber 142 causes fuel to flow from fuel chamber 142 through the main metering system. That is, the fuel flows through metering restriction 134, conduit means 106, up through well 86 and, after mixing with the bleed air supplied by the main well air bleed means 130, passes through aligned conduit means 102 and 64 and discharges from nozzle 50 into induction passage means 34. Generally, the calibration of the various controlling elements are such as to cause such main metered fuel flow to start to occur at some pre-determined differential between fuel reservoir (usually ambient) and venturi pressure. Such a differential may exist, for example, at a vehicular speed of 30 m.p.h. at normal road load.

Engine and vehicle operation at conditions less than that required to initiate operation of the main metering system are achieved by operation of the idle fuel metering system, which may not only supply metered fuel flow during curb idle engine operation but also at off idle operation.

At curb idle and other relatively low speeds of engine operation, the engine does not cause a sufficient rate of air flow through the venturi section 48 as to result in a venturi vacuum sufficient to operate the main metering system. Because of the relatively almost closed throttle valve means 52, which greatly restricts air flow into the intake manifold 26 at idle and low engine speeds, engine or intake manifold vacuum is of a relatively high magnitude. This high manifold vacuum serves to provide a pressure differential which operates the idle fuel metering system.

Generally, the idle fuel system is illustrated as comprising calibrated idle fuel restriction metering means 110 and passage means 100 communicating as between a source of fuel, as within, for example, the fuel well 86, and conduit means 92 which, in turn, communicates with a generally upwardly extending passage or conduit 96 the lower end of which communicates with a generally laterally extending conduit 98 which communicates with conduit portion 66. The downwardly depending conduit 72 communicates at its upper end with conduit 66 and at its lower end with induction passage means 34 as through aperture means 68. The effective size of discharge aperture 68 may be variably established as by an axially adjustable needle valve member 70 threadably carried by body means 32. As generally shown and as generally known in the art, passage 66 may terminate in a relatively vertically elongated discharge opening or aperture 74 located as to be generally juxtaposed to an edge of throttle valve 52 when such throttle valve 52 is in its curb-idle or nominally closed position. Often, aperture 74 is referred to in the art as being a transfer slot effectively increasing the area for flow of fuel to the underside of throttle valve 52 as the throttle valve is moved toward a more fully opened position.

As generally depicted, conduit means 92 is also in communication with conduit 60 and calibrated restriction means 62 serving as an idle air bleed restriction.

At idle engine operation, the greatly reduced pressure, in the area generally below the throttle valve means 52 causes fuel to flow as from the fuel reservoir 142 and well 86 through conduit means 100 and restriction means 110 and generally intermixes with the bleed air provided through conduits 60 and 92 and air bleed restriction means 62. The resulting fuel-air emulsion then is drawn downwardly through conduit 96 and through conduits 98, 66 and 72 ultimately discharged, posterior to throttle valve 52, through the effective opening of aperture 68.

During off-idle operation, the throttle valve means 52 is moved in the opening direction causing the juxtaposed edge of the throttle valve to further effectively open and expose a greater portion of the transfer slot or port means 74 to the manifold vacuum existing posterior to the throttle valve. This, of course, causes additional metered idle fuel flow through the transfer port means 74. As the throttle valve means 52 is opened still wider to accommodate increases in engine speed and load, the velocity of air flow through the induction passage 34 increases to the point where the resulting developed venturi vacuum is sufficient to cause the hereinbefore described main metering system to be brought into operation.

The invention as herein disclosed and described provides means, in addition to those hereinbefore described, for controlling and/or modifying the metering characteristics otherwise established by the fluid circuit constants previously described. In the embodiment disclosed, among other cooperating elements, solenoid valving means 152 is provided to enable the performance of such modifying and/or control functions.

The solenoid valving means 152 is illustrated in greater detail in FIG. 3 and the detailed description thereof will hereinafter be presented in regard to the consideration of said FIG. 3. However, at this point, and still with reference to FIG. 2, it will be sufficient to point out that, in the embodiment disclosed, the solenoid means or assembly 152 has an operative upper end and an operative lower end and that such means or assembly 152 is preferably carried by the housing or body means 144 as, for example, to be partly received by the fuel reservoir 142. As generally depicted in FIG. 2, the lower operative end of solenoid valving means or assembly 152 is operatively received as by an opening 154 formed as in the interior of fuel reservoir 142 with such opening 154 generally, in turn, communicating with passage means 156 ultimately leading to the main fuel well 86.

As also depicted in FIG. 2, the upper end of solenoid assembly 152 may be generally received through housing or body means 144 as to have the upper end of assembly 152 received as by an opening 160 formed as within a cap-like housing or body portion 162 which has a relatively enlarged passage or chamber 164 formed therein and communicating with laterally extending passages or conduits 166 and 168 which, in turn, respectively communicate with illustrated downwardly extending passage or conduits 170 and 172. A conduit 174, serves to interconnect and complete communication as between the lower end of conduit 170 and conduit 94, while a second conduit 176 serves to interconnect and complete communication as between the lower end of conduit 172 and, through conduit means 88, a source of ambient atmosphere as, preferably, at a point in the air inlet end of induction passage means 34. Such may take the form of an opening 178, communicating with passage means 34, already existing in pre-existing body means 32 or subsequently formed therein and situated generally downstream of choke or air valve means 38.

Figure 3:
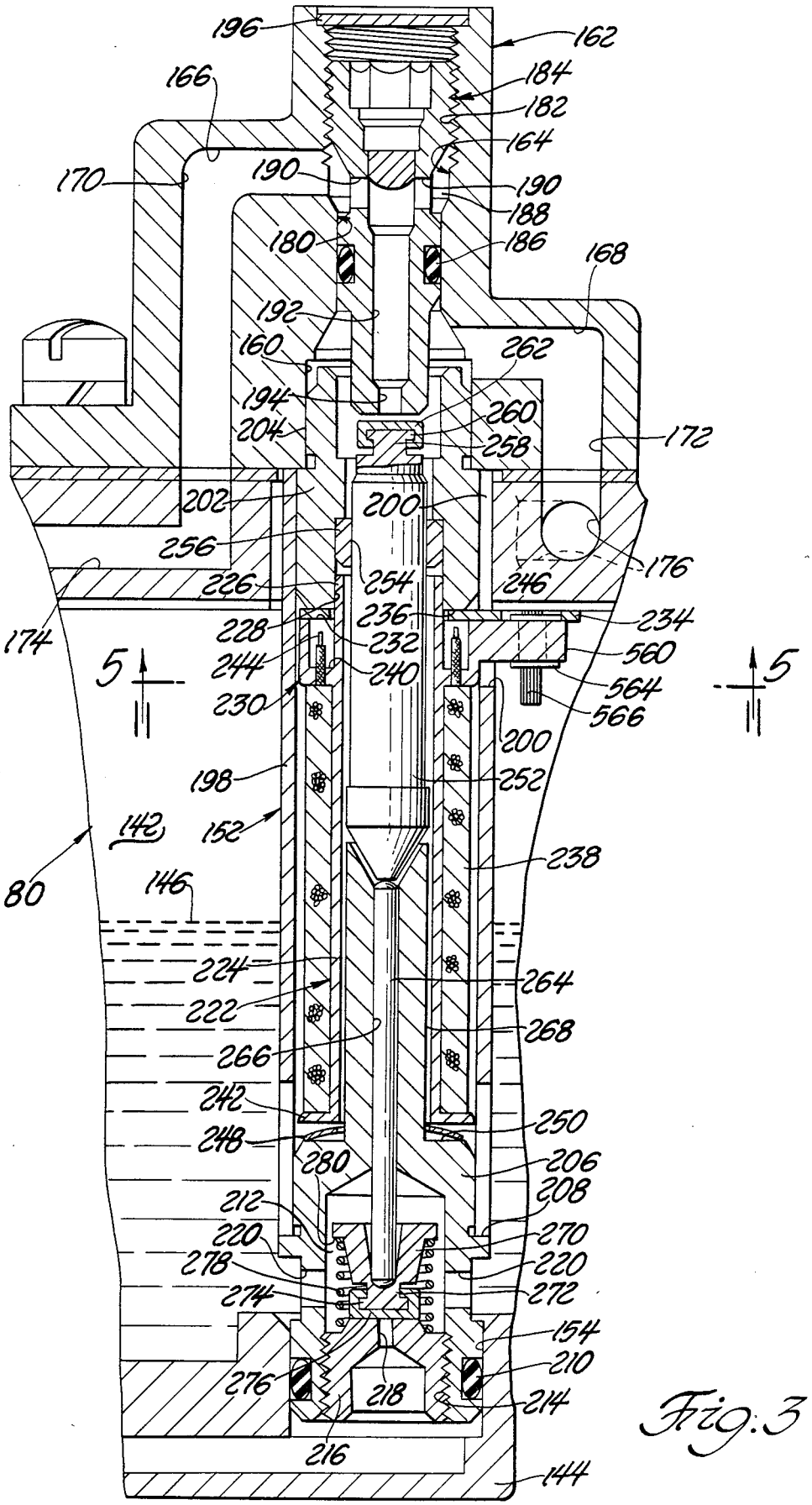
FIG. 3 is an enlarged axial cross-sectional view of one of the elements shown in FIG. 2 with fragmentary portions of related structure also shown in FIG. 2.

Referring in greater detail to both FIGS. 2 and 3, and in particular to FIG. 3, chamber 164 of housing portion 162 is shown as having a cylindrical passage portion 180 with an axially extending section thereof being internally threaded as at 182 in order to threadably engage a generally tubular valve seat member 184 which has its inner-most end provided with an annular seal, such as an O-ring, 186 thereby sealing such inner-most end of member 184 against the surface of cylindrical passage portion 180. As depicted, valve seat member 184 is generally necked-down at its mid-section thereby providing for an annular chamber 188 thereabout with such annular chamber 188 being, of course, partly defined by a cooperating portion of chamber or passage means 164. A plurality of generally radially directed apertures or passages 190 serve to complete communication as between annular chamber 188 and an axially extending conduit 192, formed in the body of valve seat member 184, which, in turn, communicates with a valve seat calibrated orifice or passage 194. After the valve seat member 184 is threadably axially positioned in the selected relationship, a suitable chamber closure member 196 may be placed in the otherwise open end of chamber 164.

The solenoid assembly 152 is illustrated as comprising a generally tubular outer case 198 the upper end of which is slotted, as depicted at 200, and receives an upper end sleeve member 202 which may be secured to the outer case or housing 198 as by, for example, having the end member 202 pressed into the housing 198 and then further crimping housing 198 against member 202. The outer surface 204 of the upper end of sleeve member 202 is closely received within cooperating receiving opening 160.

A generally lower disposed end sleeve member 206 may be similarly received by the lower open end of case or housing 198 and suitably secured thereto as by, for example, crimping. Preferably, sleeve member 206 is provided with a flange portion 208 against which the end of case 198 may axially abut. The lower-most end of sleeve member 206 is closely received within cooperating opening or passage 154 and is provided with an annular groove or recess which, in turn, receives and retains a seal, such as, for example, an "O"-ring, 210 which serves to assure such lower-most portion of sleeve 206 being peripherally sealed against the surface of opening 154. A generally medially situated chamber 212, formed in sleeve member 206 is preferably provided with an internally threaded portion 214 which threadably engages a threadably axially adjustable valve seat member 216 which, in turn, is provided with a calibrated valve orifice or passageway 218 effective for communicating as between chamber 212 and passage or conduit means 156. A plurality of generally radially directed apertures or passages 220 serve to complete communication as between chamber 212 and the interior of the fuel reservoir 142.

A spool-like member 222 has an axially extending cylindrical tubular portion 224 the upper end 226 of which is closely received within a cooperating recess-like aperture 228 provided by upper sleeve member 202. Near the upper end of spool member 222, such member is provided with a generally cylindrical cup-like portion 230 which, in turn, defines an upper disposed abutment or axial end mounting surface 232 which abuts as against a flat insulating member 234 situated against the lower end surface 236 of upper sleeve member 202 and about the upper portion 226 of tubular portion 224. An electrical coil or winding 238, carried generally about tubular portion 224 and between axial end walls 240 and 242 of spool 222, may have its leads 244 and 246 pass as through wall portion 240 for connection to related circuitry, to be described. An annular bowed spring 248 is axially contained between end wall 242 of spool 222 and the upper face 250 of lower sleeve member 206 and serves to resiliently hold the spool and coil assembly (222 and 238) in its depicted assembled condition within case or housing 198.

A cylindrical armature 252, slidably reciprocatingly received within tubular portion 224 and aligned passageway 254, formed as in a bushing member 256 situated in sleeve member 202, has an upper disposed axial extension 258 and an integrally formed annular flange-like portion 260 which internally engage and both laterally and axially retain a related, at least somewhat resilient, generally cup-like valve member 262.

Somewhat similarly, the lower end of armature 252 is in operative abutting engagement with an axial extension such as a pin or rod 264 which passes through a clearance passageway 266, formed in lower sleeve member 206, (including its tubular extension 268 received with tubular portion 224 of spool 222) and abutably engages a lower disposed valving member 270 which is provided with an axial extension 272 and integrally formed annular flange 274 which internally engage and laterally and axially retain, at least a somewhat resilient, generally cup-like valve member 276. A compression spring 278 has one end seated as against valve seat member 216 and its other end seated against a suitable flange portion 280 of valving member 270 as to thereby normally yieldingly urge the valve member 276 and armature 252 axially away from the valve seat member 216 (that being the opening direction for valve passageway 218).

As generally fragmentarily illustrated, in the preferred embodiment, housing or body means 144 is provided with a separate securably detachable cover-like portion 282, to which body means 162 may be secured and in which the various passage means may be formed as generally depicted.

As should be apparent, upon energization and de-energization of the coil 238, armature 252 will experience reciprocating motion with the result that, in alternating fashion, valve member 262 will close and open calibrated passageway 194 while valve member 276 will open and close calibrated passageway 218.

Without, at this point, considering the overall operation, it should now be apparent that when, for example, armature 252 is in its upper-most position and valve member 262 has fully closed passageway or orifice 194, all communication between conduits 166 and 168 is terminated. Therefore, the only source for any bleed air, to be mixed with raw or solid fuel being drawn through conduit means 100 (to thereby create the fuel-air emulsion previously referred to herein), is through bleed air passage 92, 60 and calibrated bleed air restriction mean 62 (FIG. 2). The ratio of fuel-to-air in such an emulsion (under such an assumed condition) will be determined by the restrictive quality of air bleed restriction means 62, alone.

However, let it be assumed that armature 252 has moved to its lower-most position, as depicted, and that valve member 262 has, thereby, fully opened calibrated passageway 194. Under such an assumed condition, it can be seen that communication, via passage or orifice 194, is completed as between conduits 166 and 168 with the result that now, the top of conduit 100 (FIG. 2) is in controlled (by virtue of the restrictive qualities or characteristics occurring at passageway 194) communication with a source of ambient atmosphere via conduits 96, 94, 174, 170, 166, 190, 192, 194, 168, 172, 176 and 88 and opening 178 (FIG. 2). Accordingly, it can be seen that under such an assumed condition the source for bleed air, to be mixed with raw or solid fuel being drawn through conduit means 100 (to thereby create the fuel-air emulsion hereinbefore referred to), is through both bleed air passage 92, 60 and restriction means 62 as well as conduit means 176 as set forth above. Therefore, it can be readily seen that under such an assumed condition significantly more bleed-air will be available and the resulting ratio of fuel-to-air, in such an emulsion, will be accordingly significantly leaner (in terms of fuel) than the fuel-to-air ratio obtained when only conduit 92, 60 and restriction 62 were the sole source of bleed air.

Obviously, the two assumed conditions discussed above are extremes and an entire range of conditions exist between such extremes. Further, since the armature 252 and valve member 262 will, during operation, intermittently reciprocatingly open and close passageway or orifice 194, the percentage of time, within any selected unit or span of time used as a reference, that the orifice 194 is opened will determine the degree to which such variably determined additional bleed air becomes available for intermixing with the said raw or solid fuel.

Generally, and by way of summary, with proportionately greater rate of flow of idle bleed air, the less, proportionately, is the rate of metered idle fuel flow thereby causing a reduction in the richness (in terms of fuel) in the fuel-air mixture supplied through the induction passage 34 and into the intake manifold 26. The converse is also true; that is, as aperture or orifice means 194 is more nearly totally, in terms of time, closed, the total rate of idle bleed air becomes increasingly more dependent upon the comparatively reduced effective flow area of restriction means 62 thereby proportionately reducing the rate of idle bleed air and increasing, proportionately, the rate of metered idle fuel flow and, thereby resulting in an increase in the richness (in terms of fuel) in the fuel-air mixture supplied through induction passage 34 and into the intake manifold 26.

Further, and still without considering the overall operation of the invention, it should be apparent that for any selected metering pressure differential between the venturi vacuum, $P_v$, and the pressure, $P_a$, within reservoir 142, the "richness" of the fuel delivered by the main fuel metering system can be modulated merely by the moving of valve member 276 toward and/or away from coacting aperture means 218. That is, for any such given metering pressure differential, the greater the effective opening of aperture 218 becomes, the greater also becomes the rate of metered fuel flow since one of the factors controlling such rate is the effective area of the metering orifice means. Obviously, in the embodiment disclosed, the effective flow area of orifice means 218 is fixed; however, the effectiveness of flow permitted therethrough is related to the percentage of time, within any selected unit or span of time used as a reference, that the orifice means 218 is opened (valving means 270 and valve member 276 being moved away from passage means 218) thereby permitting an increase in the rate of fuel flow through passages 220, 212, 218 and 156 ultimately to main fuel well 86 (FIG. 2). With such opening of orifice means 218 it can be seen that the metering area of orifice means 218 is, generally, additive to the effective metering area of orifice means 134. Therefore, a comparatively increased rate of metered fuel flow is consequently discharged, through nozzle 50, into the induction passage means 34. The converse is also true; that is, the less that orifice means 218 is effectively open or opened, the total effective main fuel metering area effectively decreases and approaches that effective area determined by metering means 134. Consequently, the total rate of metered main fuel flow decreases and a comparatively decreased rate of metered fuel flow is discharged through nozzle 50 into the induction passage 34.

Referring again to FIG. 1, it can be seen that suitable vehicular speed sensing means 280 may be operatively connected to the engine power output train, as, for example, to the output or drive shaft means 13. The speed sensing means 280 is of the type which senses the speed of rotation and, in turn, produces an electrical output signal, as along conductor means 284, 286, which is of a magnitude reflective of such sensed speed. Such a speed signal is then applied, as an input signal to the control and computer means 288 which may be powered as by a suitable source of electrical potential 290 indicated as being grounded as at 292.

Figure 4:
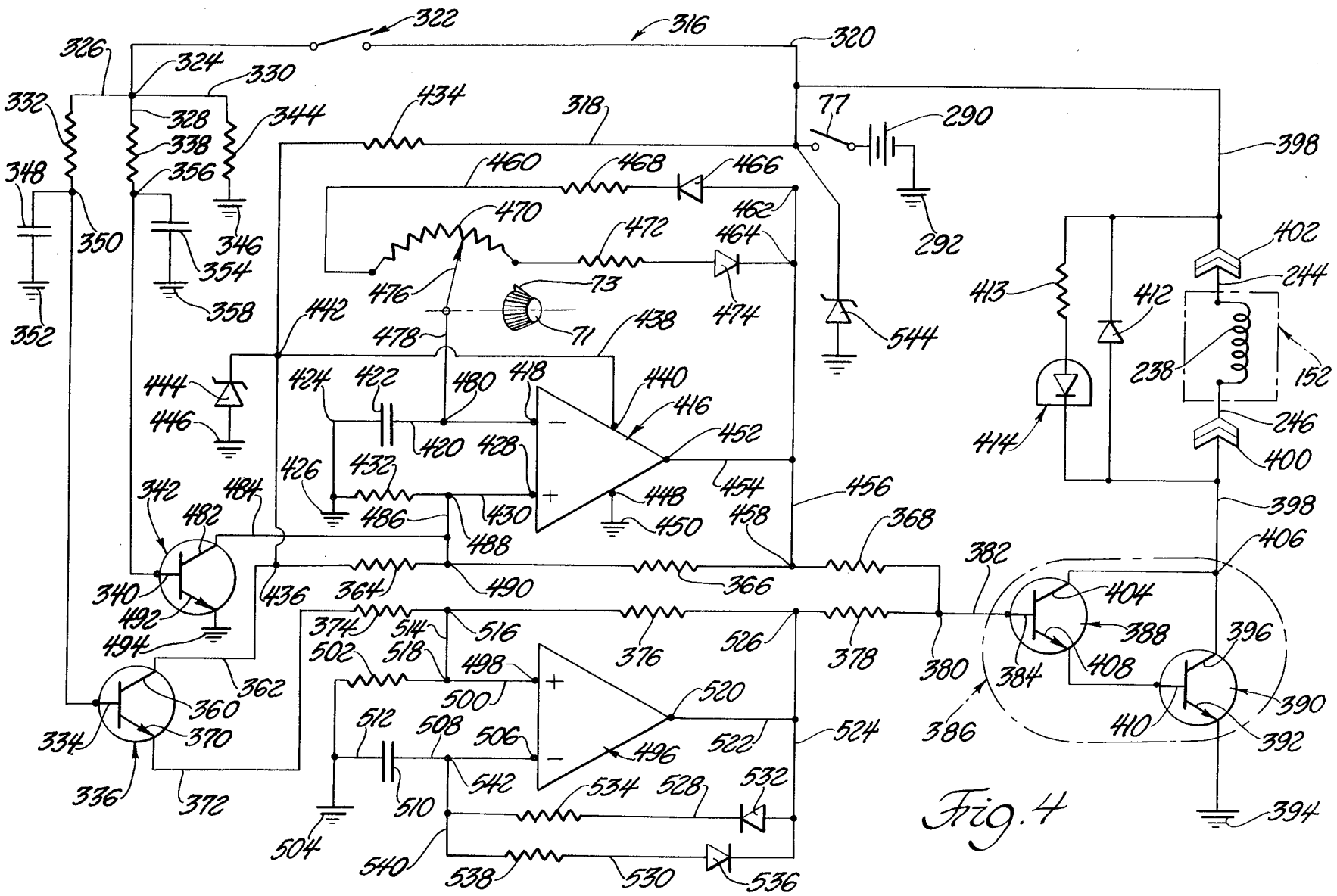
FIG. 4 is a schematic wiring diagram of circuitry employable in practicing the invention.

Although the practice of the invention is not limited to any specific form or embodiment of a control and computer means 288, if at all, it has been discovered during testing of the invention that a commercially available apparatus designated as a "ZT3 Driving Computer" and sold by Zemco, Inc. of 12907 Alcosta Blvd., San Ramon, California, U.S.A. (and also described in a publication captioned *ZT3* DRIVING COMPUTER and bearing a copyright notice of 1980 by Zemco, Inc.) provides acceptable performance. Further, as will become, apparent, such a commercially available control and computer 288 may be modified as by the incorporation or the addition thereto of circuit means as generally depicted in FIG. 4. That is to say, in the present disclosure, it is assumed that the means 288 as depicted in FIG. 1 includes the circuit means of FIG. 4 or the functional equivalent thereof. However, that is not to mean that the invention is limited to such a combination since the various circuits and computer means may actually be physically separated from each other and only operatively interconnected.

Similarly, even though the practice of the invention is not limited to the use of any specific form or embodiment of a speed sensing means 280, if at all used, it has been discovered during testing of the invention that a commercially available apparatus designated as a portion of an overall kit comprising said "ZT3 Driving Computer" provides acceptable performance.

Still referring to FIG. 1, a vehicular fuel tank 148 is shown supplying fuel as via conduit means 300 to the inlet of an associated fuel pump 150 which, in turn, pumps such fuel as via conduit means 304 to the inlet of the fuel reservoir 142 of structure 80. A flow sensor means 306, illustrated as comprising a portion of the conduit means 304, senses the rate of flow, per unit of time, of fuel to the carbureting means 28, and therefore to the engine 10, and in accordance therewith produces an electrical output signal which is applied as via conductor means 308 and 310 as an input signal to the control means 288. Again, even though the practice of the invention is not limited to the use of any specific form or embodiment of a flow sensor means 306, if at all used, it has been discovered during testing of the invention that a commercially available apparatus designated as a portion of an overall kit comprising said "ZT3 Driving Computer" provides acceptable performance. A pair of electrical conductor means 312 and 314 are illustrated as electrically interconnecting the control means 288 and carburetor means 28, and, more specifically, the coil 238 leads 244, 246 of the solenoid valving means 152 (FIGS. 2 and 3).

In the preferred embodiment, the control means 288 would comprise suitable housing means the face of which could carry or provide suitable push-button means 49, 51, 53, 55, 57, 61, 63, 65 and 67 along with a visual read-out digital display 69. Such push-buttons, when actuated, could result in the digital display providing a read-out of various bits of information. For example upon actuation of: (a) 49, the display could indicate the rate of fuel consumption in terms of miles per gallon, or the like; (b) 51, the display could indicate the vehicular speed; (c) 53, the display could indicate the elapsed time as from, for example, the beginning of a trip; (d) 55, the display could indicate the then time of day; (e) 57, the display could indicate the distance traveled as, for example, from the start of a trip; (f) 61, the display could indicate the quantity of fuel consumed as from the start of a trip; (g) 63, the display could indicate the average speed of the vehicle as, for example, from the start of a trip and (h) 65, the associated circuitry and display would be reset.

Also, in the preferred embodiment, the control means 288 could carry a manually adjustable control member 71 as in the form of, for example, a rotatable knob which may be provided with a pointer 73 so that as the control knob 71 is rotated the pointer 73 would generally sweep across or in respect to radiating graduations 75 with the left-most (as viewed in FIG. 1) thereof being designated as "Rich", or the like, and the right-most (as viewed in FIG. 1) being designated as "Lean", or the like.

Generally, as is well known, as the vehicle is being operated, the signals generated and supplied by the speed sensor means 280 and the flow sensor means 306 are integrated by the circuitry of the computer portion of the control means 288 so that, depending upon the function selected as by the actuation of a push-button, the corresponding information is presented by the digital display 69.

Referring now in greater detail to FIG. 4 wherein control circuit means 316 employable in the invention is illustrated as comprising a source of electrical potential, which may be the same source 290 as shown in FIG. 1, grounded as at 292 and having its other terminal electrically connected, as through engine ignition switch means 77, to conductor means 318 and 320. A normally open electrical switching means 322 is shown as being in series with conductor means 320 which, at its other end, may be considered as being electrically connected as at juncture means 324 to conductor means 326, 328 and 330.

The other end of conductor means 326, which comprises series resistor means 332, is electrically connected to the base terminal 334 of an N-P-N transistor 336 while the other end of conductor means 328, which comprises series resistor means 338, is electrically connected to the base terminal 340 of a second N-P-N transistor 342. Conductor means 330, illustrated as comprising series resistor means 344, is connected to ground potential as at 346.

A first capacitor means 348 has one of its electrical sides electrically connected to conductor means 326 as at a point 350 electrically between resistor means 332 and base terminal 334 of transistor 336 while its other electrical side is brought to ground as at 352. Similarly, a second capacitor means 354 has one of its electrical sides electrically connected to conductor means 328 as at a point 356 electrically between resistor means 338 and base terminal 340 of transistor 342 while its other electrical side is brought to ground as at 358.

The collector electrode or terminal 360 of transistor 336 is electrically connected to conductor means 362 which comprises series situated resistance means 364, 366 and 368 while the emitter electrode or terminal 370 of transistor 336 is electrically connected to conductor means 372 which comprises series situated resistance means 374, 376 and 378. Conductor means 362 and 372 may be electrically joined as at 380 and, in turn, electrically coupled as via conductor means 382 to the base terminal 384 of a Darlington circuit 386 which comprises N-P-N transistors 388 and 390. The emitter electrode 392 of transistor 390 is connected to ground as at 394 while the collector 396 thereof is electrically connected as by conductor means 398 connectable, as at 400 and 402, to the solenoid means 238, and leading to the related source of electrical potential as by, for example, electrical connection through conductor means 320.

The collector 404 of transistor 388 is electrically connected to conductor means 398, as at point 406, while the emitter 408 thereof is electrically connected to the base terminal 410 of transistor 390. Preferably, a diode 412 is placed in parallel with solenoid means 238. Although not essential to the practice of the invention, it is, nevertheless, preferred that a light emitting diode 414 (or the like) be provided, in series with resistor 413, to visually indicate the condition of operation.

A first operational amplifier 416 is illustrated as having its inverting input terminal 418 electrically connected as via conductor means 420 to one electrical side of capacitor means 422 the other electrical side of which is connected as via conductor means 424 to ground as at 426. The positive (+) terminal 428 of amplifier 416 is also connected to ground 426 as through conductor means 430 comprising series resistance means 432.

Conductor means 318, which may comprise suitable series situated resistance means 434, is electrically connected to conductor means 362 as at a point 436 generally on the collector 360 side of resistance means 364. An internal power supply conductor means 438 is electrically connected as between terminal 440 of amplifier 416 and conductor means 318 as at a point 442 thereof. A zener diode 444, grounded as at 446, may also be connected to point 442 as to thereby regulate the potential at points 442 and 436 as well as across the amplifier terminals 440 and 448 with terminal 448 being grounded as at 450.

The output terminal 452 of amplifier 416 is connected as by conductor means 454 to conductor means 456 which, at its lower end is connected to conductor means 362 as at a point 458 electrically between resistance means 366 and 368, and which at its upper portion (as viewed in FIG. 4) is connected to what may be considered a looped conductor means 460 as at points 462 and 464. In the preferred embodiment, conductor means 460 comprises series situated diode 466, resistance means 468, potentiometer resistance means 470, resistance means 472 and diode means 474. The potentiometer wiper contact 476, positioned as by the manual control knob 71, is electrically connected, as via conductor means 478, to inverter input terminal 418 as by its connection to conductor means 420 as at a point 480 generally electrically between capacitor means 422 and terminal 418.

The collector 482 of transistor 342 is electrically connected to the positive input terminal 428 of amplifier 416 and to conductor means 362 as by conductor means 484 and 486 wherein conductor means 486 may have one end connected to conductor means 430, as at a point 488 thereof generally electrically between resistance means 432 and terminal 428, and may have its other end connected to conductor means 362 as at a point 490 thereof generally electrically between resistance means 364 and 366. The emitter 492 of transistor 342 is brought to ground as at 494.

A second operational amplifier 496 has its positive input terminal 498 electrically connected as to conductor means 500, comprising series resistance means 502, leading to ground as at 504. The inverting input terminal 506 of amplifier 496 is electrically connected as by conductor means 508 to one electrical side of capacitor means 510 which has its other electrical side connected as via conductor means 512 and 500 to ground 504. A conductor means 514 serves to electrically interconnect input terminal 498 and conductor means 372 as by having its opposite ends respectively connected to conductor 372, as at a point 516 thereof generally electrically between resistance means 374 and 376 and to conductor 500, as at a point 518 thereof generally electrically between terminal 498 and resistance 502.

The output terminal 520 of amplifier 496 is electrically connected, as via conductor means 522, to conductor means 524 which has its one end electrically connected to conductor means 372 as at a point 526 thereof generally electrically between resistance means 376 and 378. The other end, generally, of conductor 524 is connected as to conductor means 528 and 530 which respectively comprise diode means 532 and resistance means 534, and, diode means 536 and resistance means 538. The other respective ends of conductor means 528 and 530 are each electrically connected to the inverting input terminal 506 as by conductor means 540 which is illustrated as being electrically connected to conductor means 508 as at a point 542 thereof generally electrically between terminal 506 and capacitor means 510.

As depicted, suitable zener diode means 544 may be provided as to regulate the potential across 238 and as across point 324 to points 494 and 394.

In one successful embodiment of the circuit means of FIG. 4, the following elements had the respectively indicated values:

| | |
|---|---|
| Resistor 332: | 100 K |
| Resistor 338: | 100 K |
| Resistor 344: | 100 K |
| Resistor 364: | 1.0 Meg. |
| Resistor 366: | 1.0 Meg. |
| Resistor 368: | 27 K |
| Resistor 374: | 1.0 Meg. |
| Resistor 376: | 1.0 Meg. |
| Resistor 378: | 27 K |
| Resistor 468: | 200 K |
| Resistor 470: | 1.0 Meg. |
| Resistor 472: | 200 K |
| Resistor 432: | 1.0 Meg. |
| Resistor 502: | 1.0 Meg. |
| Resistor 534: | 200 K |
| Resistor 538: | 2.5 Meg. |
| Capacitor 348: | .01 μf |
| Capacitor 354: | .01 μf |
| Capacitor 422: | 0.10 μf |
| Capacitor 510: | .047 μf |

The integrated circuit portions or amplifiers 416 and 496 actually comprised type LM358 (low power dual operational amplifiers) manufactured by National Semiconductor Corp. of 2900 Semiconductor Drive, Santa Clara, Calif., U.S.A. and described as at Page 3-148 of the publication entitled "Linear Data Book" and bearing a U.S. of America copyright notice of 1978 by National Semiconductor Corp. If further clarification is desired, terminals 520, 506, 498, 448, 428, 418, 452 and 440 correspond respectively to pins or terminals 1, 2, 3, 4, 5, 6, 7 and 8 of the dual amplifier as depicted in the "connection diagrams" appearing on said Page 3-148 of said publication "Linear Data Book". Diodes 466, 474, 532, 536 and 412 each were of the type IN4001; transistors 336 and 342 were each equivalent of the type 2N4124 manufactured by Texas Instruments Incorporated of Dallas, Tex., U.S.A., and as described as at Page 4-318 of the publication entitled "The Transistor and Diode Data Book", first edition, and bearing a U.S. of America copyright notice of 1973 by Texas Instruments Incorporated. The Darlington-connected transistors 388 and 390 were equivalent of the type 2N5525 manufactured by the said Texas Instruments Incorporated and appearing as on Page 4-442 of said publication "The Transistor and Diode Data Book".

As should be apparent resistanne means 468, 470 and 472, amplifier 416, capacitor 422, resistance means 432, resistance means 366 and associated conductor means define an oscillator means wherein resistances 468, 470 and 472 generally collectively cooperate to define feedback resistance means the value of which can be adjustably selected by the wiper contact 476 of the potentiometer means.

Generally, two different situations will exist in the circuit means of FIG. 4. That is, one will exist when the ignition switch means 77 is closed and the switching means 322 is open while the other operating condition will exist when the ignition switch means 77 and the switching means 322 are both closed.

Considering first the operating condition wherein ignition switch means is closed but switching means 322 is opened, it will be seen that ground potential will exist at point 324 because of its connection to ground 346 as by resistor means 344. At this time transistors 336 and 342 are each in a non-conducting state ("off") because the ground potential of point 324 is applied via conductor means 326 and 328 to the base terminals 334 and 340 of transistors 336 and 342, respectively.

Since there is, at this time, no positive voltage being fed from or at emitter 370 of transistor 334, the operational amplifier 496 does not receive the needed positive reference voltage for the non-inverting input terminal 498 thereof and, therefore, the operational amplifier 496 is rendered effectively non-operating and no output is produced at output terminal 520 of amplifier 496.

However, because of the closure of switch means 77, a positive reference voltage is supplied via conductor means 318 to point 436 and such is, in turn, supplied from point 436 by means of resistor 364 to the non-inverting input terminal 428 of operational amplifier 416. Such a reference voltage is supplied as via conductor means 486 to terminal 428 and not brought to ground 494 because, at this time, transistor 342 is off. Consequently, the first oscillator circuit means causes the production of outputs at output terminal 452.

The first oscillator circuit means comprises resistance means 468, 470 and 472, capacitor 422 and operational amplifier 416. Generally, the output at terminal 452 will be either ground potential ("low") or up to supply voltage as, for example, 12.0 volts ("high").

Assuming now, for purposes of illustration, that the output at terminal 452 is "high", current flows from output terminal 452 through diode 466, resistor 468, potentiometer 470, wiper 476, conductor 478, capacitor 422 and conductor 424 to ground 426 thereby charging the capacitor 422. During such charging time the "high" voltage output is also applied via resistor 368 and conductor 382 to the base 384 of Darlington 386 causing the Darlington to go into conduction resulting in the energization of coil 238.

Once the capacitor 422 is sufficiently charged so that the potential on the inverting input terminal 418 starts to exceed the magnitude of the reference voltage at the non-inverting terminal 428, the operational amplifier 416 is effectively switched and the output at terminal 452 thereof becomes "low" resulting in the removal of the forward bias on the base 384 of Darlington 386 causing the Darlington 386 to become nonconductive and consequently de-energizing the solenoid coil. At the same time, the capacitor 422 starts to discharge through the discharging path comprised of conductor 478, wiper 476, potentiometer 470, resistance 472 and diode 474. Such discharging continues until the potential of the inverting input 418 becomes lower than the potential of the non-inverting input terminal 428 and, at that time, the operational amplifier 416 will again be effectively switched and the output at terminal 452 will again become "high" resulting in the repeating of the cycle by again charging capacitor 422.

Now, considering the second condition of operation wherein both switch means 77 and 322 are closed, it will be seen that positive voltage from conductor 320 is applied, via conductor means 326 and 328, to base terminals 334 and 340 of transistors 336 and 342, respectively, causing each transistor 336 and 342 to become conductive and, as will be seen, causing the said first oscillator means to become effectively inoperative while making the second oscillator means operative. The second oscillator means comprises resistor means 534 and 538, capacitor 510 and operational amplifier 496.

In such second condition of operation with both transistors 336 and 342 being conductive, points 488 and 490 are brought effectively to ground potential via conducting transistor 342, while points 516 and 518 are brought effectively to high positive supply voltage as via point 436 and conducting transistor 336.

As a consequence of point 488 being brought to ground potential, the non-inverting input terminal 428 of amplifier 416 has no reference input and therefore the amplifier 416 is rendered effectively non-operative and produces no output as at terminal 452.

However, because of points 516 and 518 being brought to high positive voltage, the non-inverting input terminal 498 of amplifier 496 has the required reference input supplied thereto. This, in turn, results in the said second oscillator means producing outputs at 520 of amplifier 496.

Generally, the output at terminal 520 of amplifier 496 will be either ground potential ("low") or up to supply voltage, as for example, 12.0 volts ("high").

Assuming now, for purposes of description, that the output at terminal 520 is "high", current flows from output terminal 520 through diode 532, resistor 534, capacitor 510 and conductor 512 to ground 504 thereby charging capacitor 510. During such charging time the "high" voltage output is also applied via resistor 378 and conductor 382 to the base 384 of Darlington 386 causing the Darlington to go into conduction and energizing solenoid coil 238.

Once the capacitor 510 is charged so that the potential on the inverting input terminal 506 starts to exceed the magnitude of the reference voltage at the non-inverting terminal 498, the operational amplifier 496 is effectively switched and the output at terminal 520 thereof becomes "low" resulting in the removal of the forward bias on the base 384 of Darlington 386 causing the Darlington 386 to become non-conductive and consequently de-energizing the solenoid coil 238. At the same time, the capacitor 510 starts to discharge through the discharging path comprising resistor 538 and diode 536. Such discharging continues until the potential of the inverting input terminal 506 becomes lower than the potential of the non-inverting input terminal 498 and, at that time, the operational amplifier 496 will again be effectively switched and the output at terminal 520 will again become "high" resulting in the repeating of the cycle by again charging capacitor 510.

Accordingly, it should now be apparent that during the first condition of operation, wherein outputs are produced by amplifier means 416, the length of time that solenoid coil means 238 is energized is a function of the charging time of capacitor means 422 through resistance means 468, potentiometer 470 and wiper 476 while the length of time that solenoid coil means 238 is de-energized is a function of the discharging time of capacitor 422 through wiper 476, potentiometer 470, resistance 472 and diode 474.

It should also be apparent that during the second condition of operation, wherein outputs are produced by amplifier means 496, the length of time that solenoid coil means 238 is energized is a function of the charging time of capacitor means 510 through diode 532, and resistance means 534 while the length of time that solenoid coil means 238 is de-energized is a function of the discharging timc of capacitor means 510 through resistance means 538 and diode 536.

With respect to the said second oscillator means, the frequency and percentage of time that a "high" output is produced are fixed, in that, the resistance values of resistance means 534 and 538 are fixed. However, with respect to the said first oscillator means, the percentage of time that a "high" output is produced at terminal 452 is variable by the provision of the potentiometer means comprised of potentiometer resistance 470 and wiper 476. Accordingly, it is apparent that with adjustment of the potentiometer wiper 476 generally counter-clockwise as viewed in FIG. 4 that the percentage of time that a "high" output is produced at 452 will decrease and consequently the percentage of time that solenoid coil means 238 is energized will be correspondingly reduced while the percentage of time that a "low" output is produced at 452 and the percentage of time that solenoid coil means 238 will be de-energized will increase. In like manner, if the potentiometer wiper 476 is selectively adjusted generally clockwise as viewed in FIG. 4, the percentage of time that a "high" output is produced at 452 and the percentage of time that solenoid coil means 238 will be energized will increase while the percentage of time that a "low" output is produced at 452 and the percentage of time the solenoid coil is de-energized will decrease.

In the embodiment as depicted in FIG. 3, it is clear that valving member 276 will be seated and closing fuel flow through passage means 218 only when solenoid winding 238 is energized, and, as already hereinbefore explained, energization of the winding or coil 238 occurs only when and during the time that the output of either amplifier 416 or 496 is "high". The values selected in the said first oscillator circuit means may be such as to enable a selection of from 30 percent to 80 percent duty cycle. That is, in the overall cycle time of the first oscillator circuit means, the output at 452 would be "high" (and solenoid winding 238 would be energized) anywhere (selectively) from 30 to 80 percent of such cycle time. Also, the circuit constants of the said second oscillator circuit means may be such as to produce a 10 percent duty cycle. That is, in the overall cycle time of the second oscillator circuit means, the output at 520 would be "high" (and solenoid winding 238 would be energized), for example, during 10 percent, or even less, of such cycle time.

Figure 5:
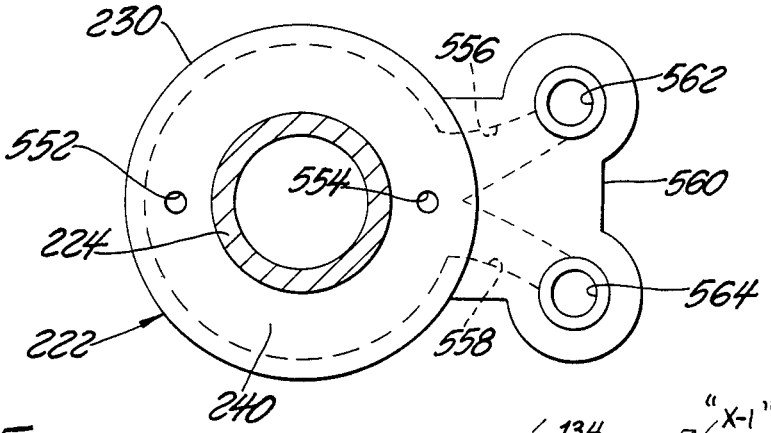
FIG. 5 is a cross-sectional view taken generally on the plane of line 5—5 of FIG. 3 and looking in the direction of the arrows.

Although various arrangements are, of course, possible, the coil 238 leads 244 and 246 (FIG. 3) may pass through suitable clearance or passage means 552 and 554 (FIG. 5) and pass through relieved portions 556, 558 (formed as in integrally formed arm portion 560) and then be respectively received as within eyelets 562, 564 which also respectively receive enlarged conductor extensions of such leads 244 and 246 (one of such being partly depicted at 566 in FIG. 3). Such extensions may, of course, be brought out of the carburetor housing means in any suitable manner as to thereby, in effect, respectively comprise the conductor means 244 and 246 as depicted in FIG. 4.

OPERATION OF INVENTION

Referring in particular to both FIGS. 2 and 3, it can be seen that when solenoid coil 238 is energized causing the valving element 276 to be stated, closing passage means 218, the upper disposed valving element 262 is moved fully away from its seated engagement and fully opening passage 194. In this position of the valving means fuel flow through main fuel passage means 218 is terminated while maximum flow of idle fuel bleed air is permitted. Such bleed air flow occurs as from inlet 178 (FIG. 2), through conduit means 176, conduit means 168, passage means 194, 192, passage or aperture means 190, conduit means 166, 170, 174 and 94 and a portion of conduit means 96. Such, of course, is in addition to the bleed air flow provided via conduit means 60 and 92. This, of course, results in the leanest (in terms of fuel) idle fuel flow being metered to the engine.

In comparison, when solenoid coil 238 is de-energized, spring means 278 moves valving element 262 upwardly as to be seated closing passage 194 while at the same time moving valving element 276 fully away from passage 218 thereby fully opening passage 218 and allowing the maximum rate of metered main fuel flow therethrough. Because of the closure of passage 194 by valving element 262, the rate of flow of idle bleed air is reduced to a minimum with such being determined by the metering action through passage means 60, 92 (FIG. 2). This, of course, results in the richest (in terms of fuel) idle fuel flow being metered to the engine.

Accordingly, it can be seen that, during a selected span of time, the richness of the idle fuel flow and of the main fuel flow will depend upon the frequency and/or duration of the energization of solenoid coil means 238. That is the greater the percentage of time that coil means 238 is energized the leaner, in terms of fuel, is the fuel-air ratio delivered to the engine and the lesser the percentage of time that coil means 238 is energized the richer, in terms of fuel, is the fuel-air ratio delivered to the engine.

Now assuming the vehicle is being operated under generally normal road-load conditions the vehicle operator may actuate the appropriate push-button on the device 288 to obtain a read-out at the display 69 indicating the then miles-per-gallon being obtained. The vehicle operator may then turn the control knob 71, for example, counter-clockwise (to a more richer fuel-air mixture) as viewed in either FIGS. 1 or 4, and observe the miles-per-gallon read-out to see if the fuel economy of the vehicle (engine) improves or decreases. If an improvement in the fuel economy is observed, further adjustment in that same direction may be continued until a maximum improvement is realized. If a decrease in fuel economy is observed, the operator may, instead, adjust the control knob 71 generally clockwise (to a leaner fuel-air mixture) as viewed in either FIGS. 1 or 4, and observe the miles-per-gallon read-out to see if the fuel economy of the vehicle (engine) improves or decreases Obviously, if an improvement in the fuel economy is observed, further adjustment in that same direction may be continued until a maximum improvement is realized.

Accordingly, it can be appreciated that with the invention a vehicle operator is, within limits, able to manually select the rate of metered fuel flow to the engine which will provide the greatest fuel economy for the then operating conditions. This, of course, means that such factors as, for example: strong vehicular head winds; varying altitudes of vehicular operation; heavier vehicle loads as, for example, pulling a trailer or the like; varying ambient temperatures and varying brands and quality of gasoline (or other fuels) may, to a great extent be compensated for during actual vehicle (engine) operation as to obtain maximum fuel economy.

In the preferred embodiment of the invention switching means 322 may be manually closed as, for example, during cold engine cranking and starting (as well as cold engine drive-away) thereby overriding the first oscillator circuit means and rendering only the second oscillator circuit means operative thereby providing for an enriched fuel mixture to the engine. The switching means 322 may be manually closed and opened, or it can be manually closed and opened in response to indicia of engine and/or vehicle operation, or, further, it can be both closed and opened in response to indicia of engine and/or vehicle operation with such indicia being reflective of, for example, any or all inputs of engine temperature, ambient temperature, elapsed time after engine starting and/or distance of vehicular travel subsequent to engine starting.

In the preferred embodiment of the invention, the various circuit constants of FIG. 4 as well as the fluid circuit constants of the fuel metering circuits are selected so that regardless of whether the vehicle operator adjusts control knob 71 to produce a maximum rich (in terms of fuel) fuel-air ratio supplied to the engine or a maximum lean (in terms of fuel) fuel-air ratio supplied to the engine, the resulting engine exhaust emissions will still be within the limits set by the governmental authorities. The graph of FIG. 6 generally depicts fuel-air ratio curves obtainable by the invention. For purposes of illustration, let it be assumed that curve 568 represents a combustible mixture, metered as to have a ratio of 0.068 lbs. of fuel per pound of air. Then, as generally shown, the invention could (depending upon the degree and direction of adjustment of knob 71 by the operator) provide a flow of combustible mixtures in the range anywhere from a selected lower-most fuel-air ratio (80 percent duty cycle operation of the said first oscillator circuit means) as depicted by curve 570 to a selected upper-most fuel-air ratio (30 percent duty cycle operation of the said first oscillator circuit means) as depicted by curve 572. As should be apparent, the invention is capable of providing an infinite family of such fuel-air ratio curves between and including curves 570 and 572. The portions of curves 570 and 572 respectively between points 574 and 576 and points 574, 578 are intended to depict, generally, what may be considered as the idle range of operation.

In the embodiment of the adaptive structure shown in FIG. 2, an output conduit portion 582, leading from the annulus 126 controlled by the power valve assembly 114 leads to and joins with conduit 108 upstream of the power valve channel restriction means 112. As a consequence of such, regardless of how much more fuel may be delivered by the valving means 152 during power valve 114 operation, the restriction means 112 serves to limit the total rate of fuel flow through conduit means 104 even though the power valve means 114 and valving or metering means 152, together, are capable of delivering a rate of fuel flow in excess of that permitted by restriction means 112. Accordingly, in this sense, and for ease of reference, the particular adaptive structure or means 76, comprised of portions 78 and 80, may be referred to as an "economy" adaptive means or structure.

STRUCTURE OF FIG. 7

Figure 7:
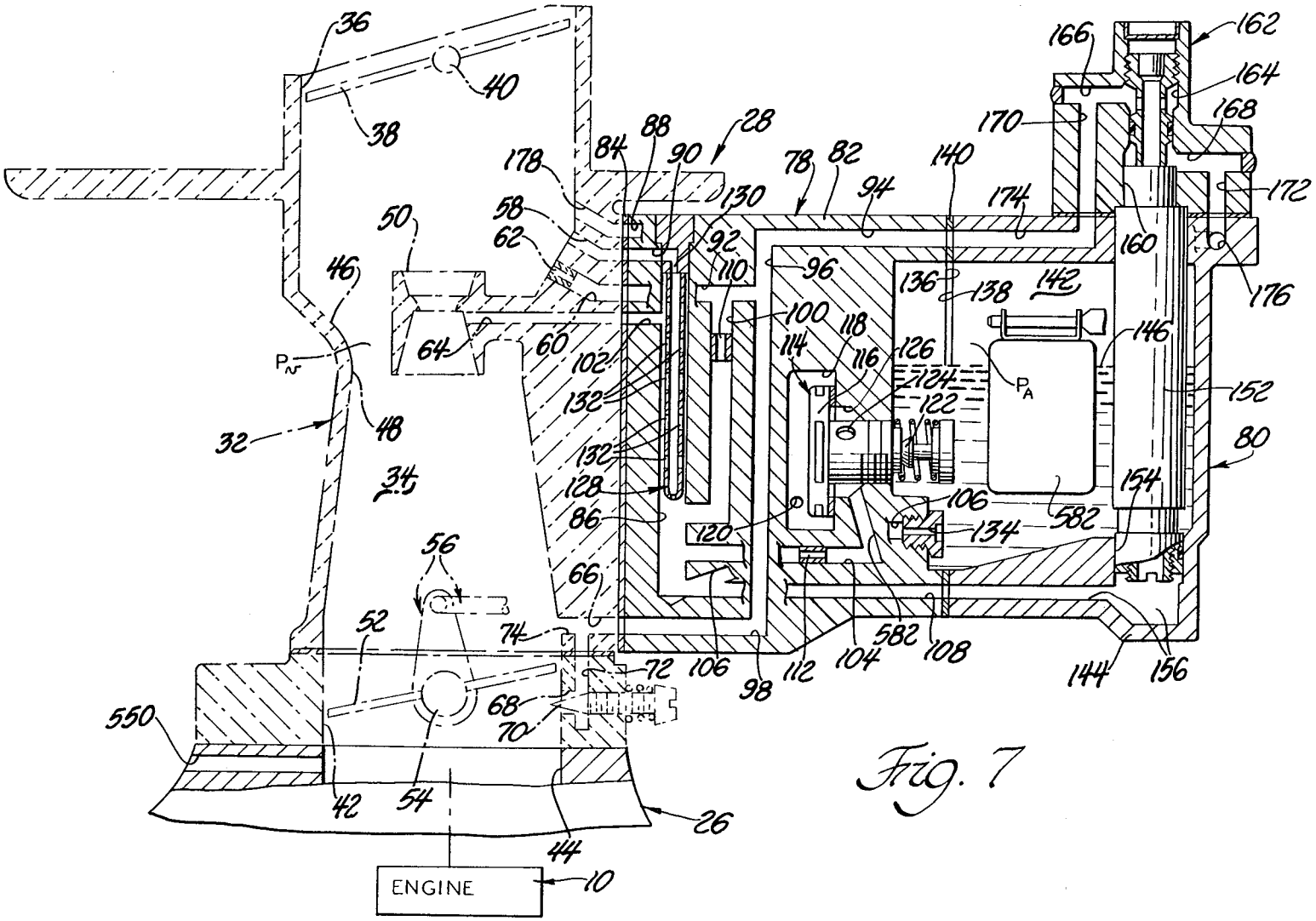
FIG. 7 is a view similar to that of FIG. 2 but illustrating a modification of the invention illustrated in FIG. 2.

FIG. 7 illustrates, in comparison, what may be referred to as a "performance" adaptive means or structure. All elements in FIG. 7 which are like or similar to those of FIG. 2 and/or 3 are identified with like reference numbers with the exception that the adaptive means, comprised of portions or sub-assemblies 78 and 80, is identified with reference number "76*a*" instead of 76 as in FIG. 2. Further, as should be apparent, a fuel inlet valve fuel bowl or reservoir float means (not illustrated in FIG. 2) is depicted at 582.

The difference between the adaptive means 76 and 76*a* resides in the fact that, in FIG. 7, fuel passages or channels 582 and 108 do not meet or join upstream of the power valve channel restriction means 112. More specifically, in FIG. 7, conduit means 108 communicates directly with fuel well 86 without having the fuel flowing through conduit means 108 being restricte by the power valve calibrated restriction means 112. Further, conduit means 582, communicating with annulus 126, does not communicate with conduit means 108 but, instead, communicates only with conduit means 104 thereby subjecting the fuel flowing from power valve means 114 to the calibrated restrictive qualities of power valve restriction means 112.

Figure 6:
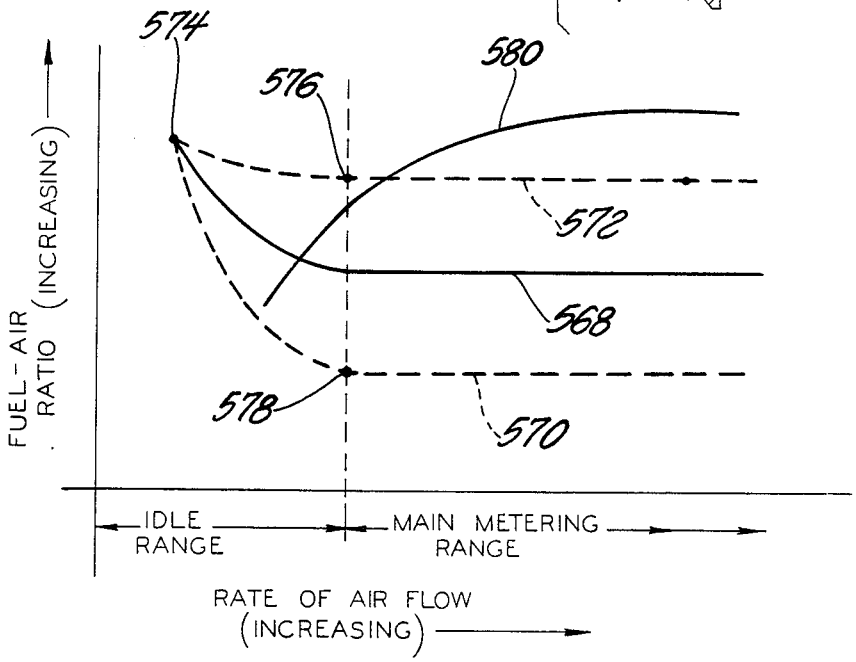
FIG. 6 is a graph illustrating, generally, fuel-air ratio curves obtainable with structures employing teachings of the invention.

As a consequence of this arrangement, during maximum load conditions with the power valve assembly 114 being opened there is no restriction to the rate of fuel flow permitted to flow from metering valving assembly means 152, through conduit means 108, to well 86 other than the metering capacity of metering valving means 152. In such an arrangement it becomes possible to control and shift both the part throttle and wide open throttle curves as generally depicted in FIG. 6 while, in comparison, in the "economy" adaptive means 76 of FIG. 2 it is only possible to control the part throttle portions of the curves generally depicted in FIG. 6.

The operation of the structure of FIG. 7, in all other respects, would be the same as hereinbefore described with reference to the structure of FIGS. 1, 2, 3, 4, 5 and 6.

The invention thus far has been described in association with carburetor body structure means having a single induction passage; however, as should be apparent, the adaptive means comprising the invention can be employed in association with carburetor body structure means having a plurality of induction passage means with, for example, a plurality of throttle valves, etc.

STRUCTURE OF FIGS. 8 AND 9

Figure 8:
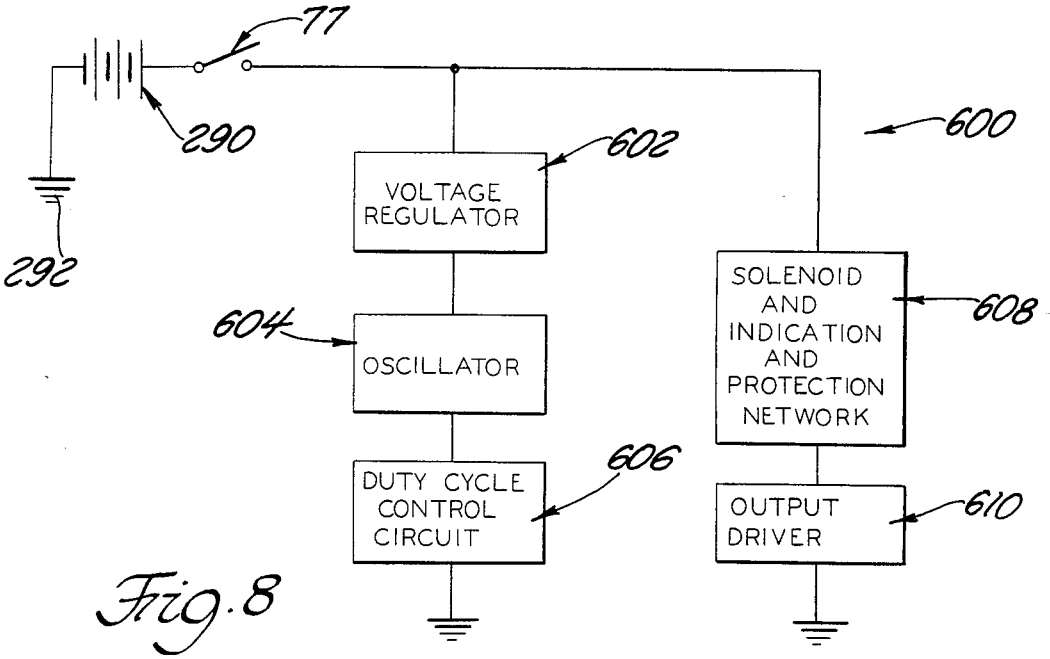
FIG. 8 is a block diagram illustrating electrical circuitry employable in the practice of the invention.
Figure 9:
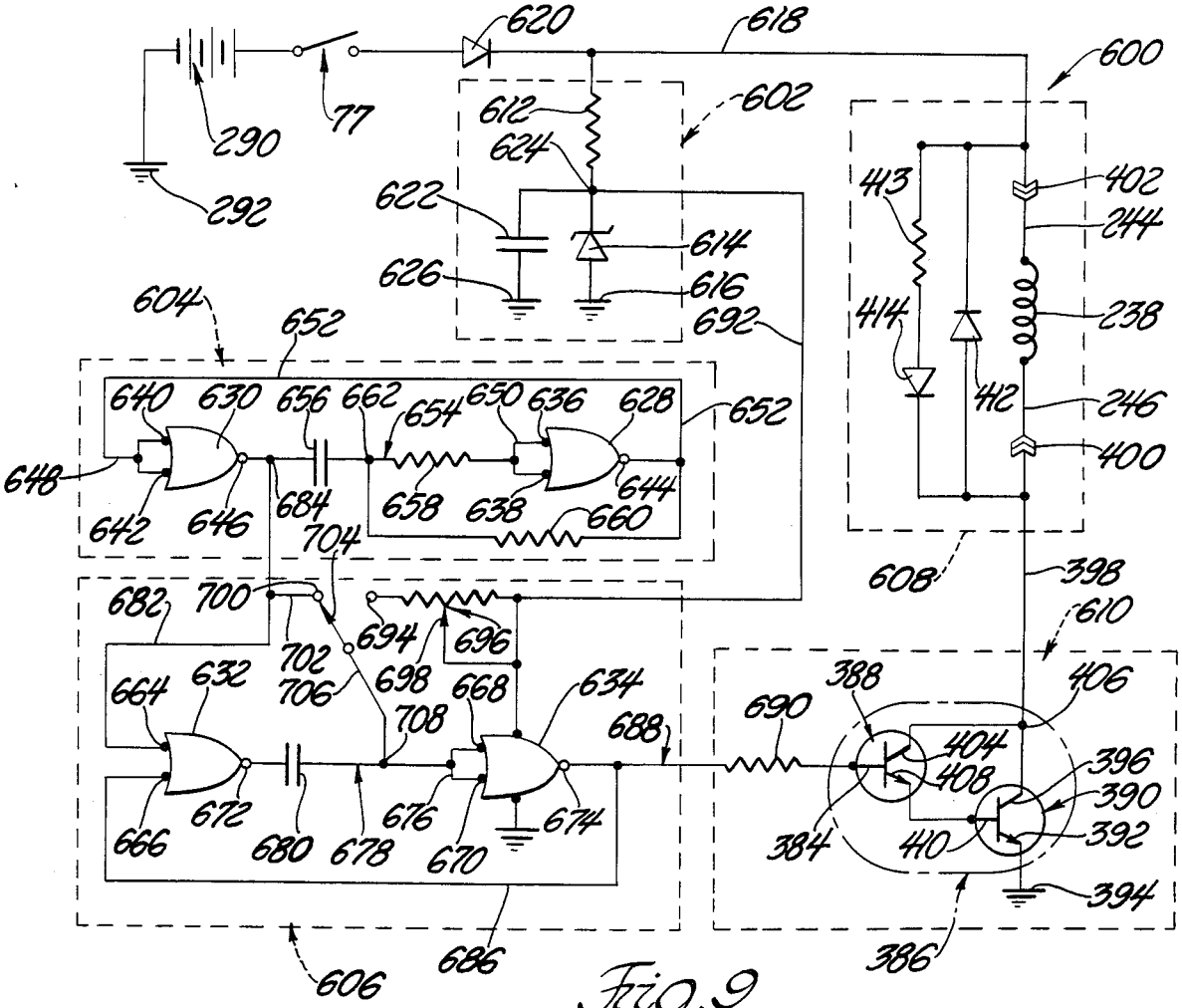
FIG. 9 illustrates, schematically, electrical circuitry corresponding to that shown in block diagram of FIG. 8.

FIGS. 8 and 9 illustrate, by way of example, another electrical circuit employable in the practice of the invention. FIG. 8 is, in effect, a block diagram of the circuitry of FIG. 9. As generally depicted, the circuitry 600 is comprised of: a voltage regulator or regulating section or portion 602; an oscillator section or portion 604; a duty cycle control circuit portion 606; solenoid and protection network 608; and output driver means 610 which are appropriately electrically interconnected and which are supplied as by the source of electrical potential 290 which may be switched as by the ignition switch means 77.

In greater particularity, referring to FIG. 9, the various portions of the circuitry 600 are depicted as generally comprising the following. The voltage regulating means 602 is illustrated as comprising series situated resistor means 612 and zener diode means 614 which, in turn, is connected to ground potential as at 616. The other end of resistance means 612 is electrically connected to conductor means 618 leading as from switch means 77 and, further, which, preferably comprises diode means 620. Preferably, ripple by-pass condenser means 622 is provided as to have one electrical side electrically connected to the resistance means 612 and zener 614 as at a point 624 generally therebetween while its other electrical side is electrically connected to ground as at 626.

The oscillator means 604 and the duty cycle control circuit means 606 in effect share a Quad 2-Input NOR Buffered B-Series Gate means which are illustrated as portions 628, 630, 632 and 634.

Referring in greater detail to the oscillator means 604, gates 628 and 630 are illustrated as respectively comprising input terminals 636, 638 and 640, 642 and, respectively, comprising output terminal means 644 and 646. As is generally apparent, both input terminals 640 and 642 are electrically interconnected by common electrical conductor means 648 and, similarly, input terminals 636 and 638 are also electrically interconnected by common electrical conductor means 650. Accordingly, whatever signal is applied to terminal 636 is also applied to terminal 638 and whatever signal is applied to input terminal 640 is also simultaneously applied to input terminal means 642.

The output terminal means 644 of gate means 628 is electrically connected to conductor means 648 and input terminal means 640, 642 as by electrical conductor means 652. The output terminal means 646 of gate means 630 is, generally, electrically interconnected to conductor means 650 and input terminal means 636 and 638 as via conductor means 654 which comprises series situated capacitor means 656 and resistance means 658. A resistor 660 is shown as having one electrical end electrically connected to the output terminal means 644, as via conductor means 652, while its other electrical end is electrically connected to conductor means 654 as at a point 662 generally between capacitor means 656 and resistor means 658.

Referring to the duty cycle control circuit means 606, the gate means 632 and 634 are shown as respectively comprising input terminal means 664, 666 and 668, 670 and, further, comprising output terminal means 672 and 674, respectively.

Input terminals 668 and 670 are electrically interconnected as by common conductor means 676 thereby resulting in both input terminal means always simultaneously receiving the same input signal. The output terminal means 672 of gate means 632 is electrically connected to input terminal means 668 and 670 via conductor means 676 and conductor means 678 which comprises capacitor means 680.

Input terminal means 664 is electrically interconnected to the output terminal means 646 of oscillator gate means 630 as via conductor means 682 which may be electrically connected to conductor means 654 as at a point 684 generally between output terminal 646 and capacitor means 656. Input terminal means 666 is electrically interconnected to output terminal means 674 as by means of conductor means 686 and 688 which, as generally depicted, comprises series resistor means 690 having its other electrical end electrically connected to the base terminal 384 of transistor 412 of Darlington 386. Although it may already be apparent, it possibly should be pointed out that certain of the elements in FIG. 9 which are like or similar to those of FIG. 4 and which have like or similar functions or means of operation to those of FIG. 4 are identified with like reference numbers to those employed in FIG. 4.

A voltage regulated power supply conductor means 692 is electrically connected as at one end as to point 624 and terminates, generally at its other depicted end, in electrical contact means 694 and, preferably, comprises variable resistance means 696 which, in turn, comprises adjustable wiper means 698.

A second electrical contact 700 is illustrated as being electrically connected to conductor means 682 as by, for example, conductor means 702. A switching means 704, switchable as to be electrically closed as with either contact means 700 or 694, is electrically connected as via conductor means 706 to conductor means 678 as at a point 708 depicted generally between capacitor 680 and input terminal means 668 and 670.

Generally, by themselves, nor gates have a characteristic so that if either input is high, the output thereof is low. If the inputs of a nor gate are electrically joined or "tied" together, the resulting circuit becomes simply an inverter in the sense that if the input is high the output of that gate is low and if the input is low the output of that gate is high.

Generally, gates 628 and 630 cooperatively define or comprise a square wave oscillator means 604 while nor gates 632 and 634 cooperate to define or comprise a one shot or single pulse generating circuit means which is triggered by the output of the oscillator means 604. Whenever the positive (or high) pulse from the oscillator means 604 is applied to input terminal 664 of gate means 632, the single pulse output at output terminal means 674 of gate means 634 becomes high (or +) for a length of time determined by the R-C time constant or timing means comprising capacitor 680 and resistance 696, assuming, of course, that at this time switch means 704 has already been electrically closed with contact means 694. By having resistance means 696 variable, the R-C time period thereof also becomes variable and it may be varied anywhere from zero (0.0) to some value greater than the period of the oscillator means 604. Therefore, a variable width pulse may be provided having a repitition rate equal to that of the oscillator means 604 and by varying the pulse width, the duty cycle of the valving means 152 can be varied from 0.0 to 100%, if such were to be desired.

The frequency of oscillation of the inverters or gates 628 and 630 is determined by capacitance means 656 and resistance means 660. Let it be assumed that the output of gate means 628, at output terminal means 644 is high. If this be the case, then it is evident that the input to terminals 636 and 638 thereof must be low. Further, the inputs to terminal means 640 and 642 of gate means 630 must be high because such inputs 640 and 642 are electrically connected via conductor means 652 to the output 644, of gate 628, which is assumed to be high. If the inputs to gate 630 are high then its output as at terminal means 646 must be low by virtue of the inverting action of gate means 630. This being the case, capacitor means 656 starts to charge with the current from output terminal means 644 (of gate 628) and through resistance means 660. As far as capacitor means 656 and resistance means 660 are concerned, output terminal means 644 appears (electrically) as if it were the positive side of a source of electrical potential (some power supply) while output terminal means 646 of gate means 630 appears (electrically) as if it were the negative side of such a source of electrical potential. Resistance means 658 does not effect the current flow, through resistor 660 and to capacitor 656, and is provided merely as protection for the input terminals 636 and 638, of gate means 628, and current does not flow through resistor 658. The electrical resistance of gate means 628 may be considered as being infinite.

The flow of current into capacitor means 656 charges the capacitor so that the polarity thereof is such as to have the side thereof electrically connected to output terminal means 646 to be negative (−) and the opposite side thereof electrically connected to resistor 660 to be positive (+). Further, since current does not flow in resistance means 658, the magnitude of the voltage at point 662 is, effectively, the magnitude of the voltage at input terminals 636 and 638 of gate means 628.

If it is assumed that the magnitude of the regulated supply voltage, via conductor means 692, is 5.0 volts, then when the voltage at point 662 increases to a value of 2.5 volts, the output of gate means 628 at output terminal means 644 will change from high to low and, consequently, the output of gate means 630 will switch from low to high.

When gate means 630 thusly switches, point 662 suddenly increases from its previous magnitude of 2.5 volts to 7.5 volts because the output of gate means 630 is now 5.0 volts and the capacitor's, 656, voltage is added in series with the output of gate means 630. Consequently, current starts flowing in a direction opposite to that direction during the charging of capacitor 656 and the voltage across the capacitor 656 starts decreasing. This continues until the voltage at point 662 decreases to a value of 2.5 volts at which time gate means 628 will again change states causing the output thereof to again become high. At this time the polarity of the respective sides of capacitor means becomes reversed from that when in the previously described charged state.

As soon as gate 628 thusly switches to have a high output, gate means 630 again switches to have a low output with the result that the voltage at point 662 becomes −2.5 volts relative to ground and the output of gate means 630. Current flow again reverses and flows through resistor 660 and into capacitor 656 charging the capacitor until the voltage across the capacitor 656 again increases to a +2.5 volts which then causes a repeat of the described cycle.

The (high and low) output of the oscillator means 604 is applied, as via conductor means 682, to input terminal means 664 of gate means 632 and whenever the output of oscillator gate means 630 is high the output of gate means 632 becomes low and whenever the output of oscillator gate means 630 is low the output of gate means 632 becomes high.

Whenever the output of gate means 632 thusly becomes low, current flows from conductor means 692, through resistance means 696, electrical contact means 694, (assumed closed thereagainst) switch means 704 and into capacitor means 680 charging such as to have the electrical side thereof, which is electrically connected to output terminal means 672, negative (−) while the opposite electrical side of capacitor means 680 becomes positive (+). During such charging, point 708 is of a relatively low magnitude thereby enabling the capacitor means 680 to maintain the magnitude of input terminal means 666 (through gating means 634) high and, therefore, keeping the output of gating means 632 low.

When the capacitor means 680 becomes sufficiently charged and the magnitude of the voltage thereof and of point 708 increase to 2.5 volts, the output of gating means 634 switches from high to low and the magnitude of the voltage at point 708 continues to increase. When the input to gate means 632 subsequently becomes low, from oscillator means 604, the output of gate means 632 becomes high. Consequently, at this time, capacitor means 680 is effectively connected between two electrical points which are at the same voltage potential, namely, the assumed 5.0 volts and, therefore, capacitor 680 begins to discharge with the current flow therefrom flowing in a direction opposite to that described with reference to the already described charging of capacitor means 680.

At the instant that the output of oscillator means 604 becomes low, the voltage at point 708 increases but then rather quickly decays to again become the (assumed) 5.0 volts. When the input from the oscillator means 604 again goes high, the capacitor 680 has, effectively, zero charge remaining and therefore point 708 becomes low, the input to gate means 634 becomes low and the output of gate means 634 becomes high. The thusly described cycle is completed and repeats.

Whenever the output of gate means 634 is high the Darlington circuit 386 is made conductive and the coil or winding 238 of valving means 152 is energized as through the collector 396 emitter 392 circuit to ground 394. During such energization pulse, valving member 276 (FIG. 3) is moved toward passage means 218 while valving member 262 is moved away from passage means 194.

During what may be considered normal operating conditions switch 704 would be closed against contact 694 and the operator would be able to selectively adjust the setting of the potentiometer wiper 698 in the same manner and for the same purpose as 476 of FIG. 4 already herein described. However, during certain conditions of operation, switch member 704 may be selectively closed against contact 700 and when such is done the output 674 assumes a constant 50% duty cycle regardless of what the operator may have previously selected via potentiometer 698. By way of example, one of such conditions may be the morning of a day that is cold thereby usually making it a bit more difficult to start the engine especially if it is further assumed that the immediately preceding night the vehicle operator shutdown the engine (while it was at normal operating temperature) with the potentiometer 698 selectively set to result in a relatively lean (in terms of fuel) fuel air mixture. In such a situation the operator, if so desired, needs only to cause the switch 704 to be closed against contact 700 and the duty cycle becomes 50% thereby increasing the rate of metered fuel flow over and above the rate which would have been provided as a result of having previously left the potentiometer 698 set atalean fuel metering rate. The vehicle operator then may start the engine and drive away keeping switch 704 closed against contact 700 until, for example, the engine has become somewhat or sufficiently warmed at which time the operator may cause the switch 704 to be closed against contact 694 thereby automatically and simultaneously returning the control of the duty cycle to the setting previously selected by the operator.

It should be made clear that even though the control circuit means of both FIGS. 4 and 9 have been found to be employable in the practice of the invention, the actual practice of the invention is not so limited and any other suitable control circuitry may be employed.

STRUCTURE OF FIG. 10

Figure 10:
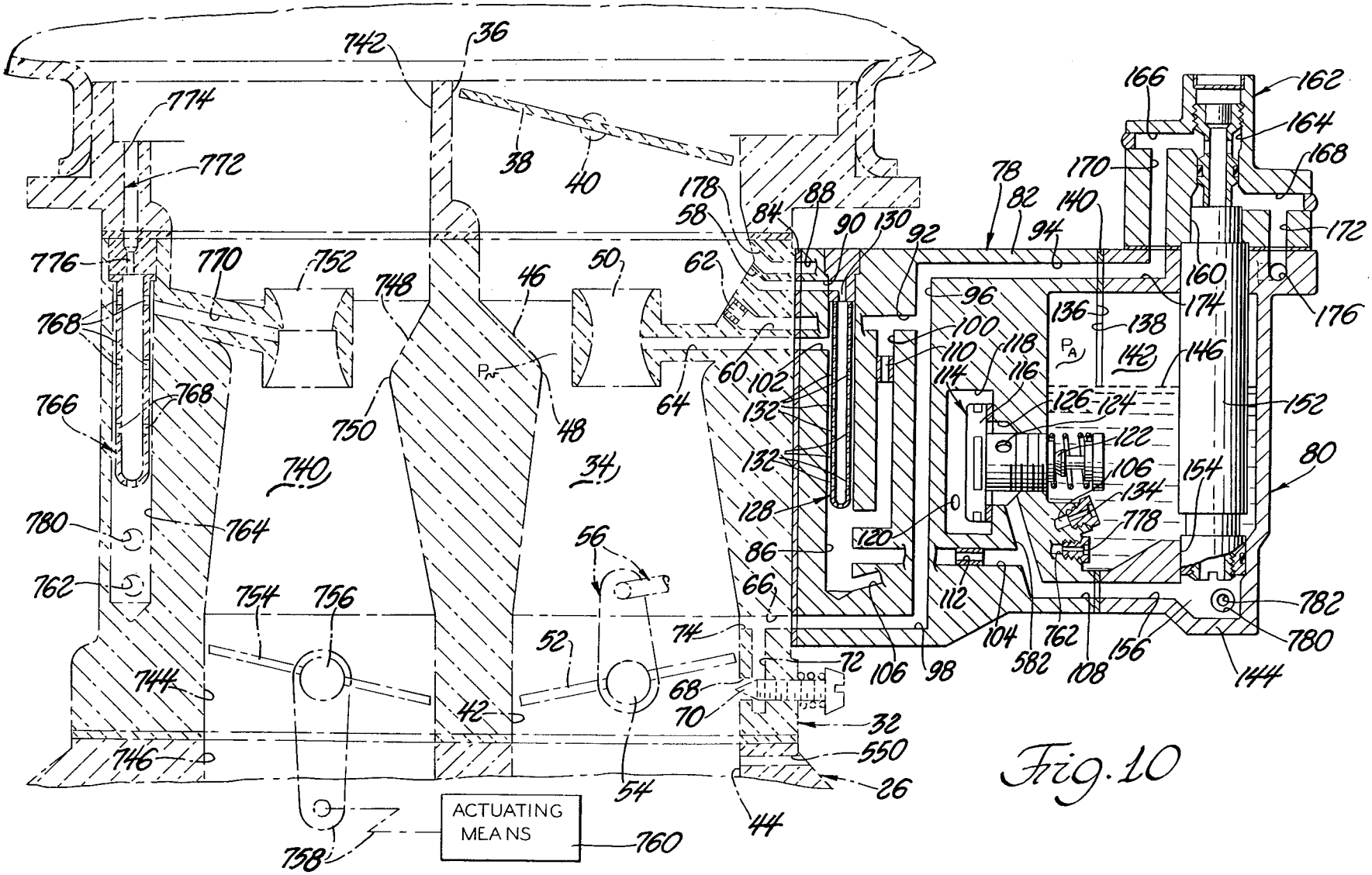
FIG. 10 is a view similar to that of FIG. 2 but illustrating the invention employed in combination with a multi-stage type carburetor structure.

FIG. 10 illustrates a manner in which the adaptive means or structure, generally comparable to that of FIG. 2, may be employed as with a multi-induction or staged carburetor body means. Generally, all elements which are like or similar to those of FIG. 2 and/or 3 are identified with like reference numbers with the exception, for example, that the adaptive means, comprised of portions of sub-assemblies 78 and 80, is identified with reference number "**76*b*" instead of 76 as in FIG. 2**.

As generally depicted, the carburetor means 28 of FIG. 10 may comprise secondary induction passage means 740 with inlet 742 and outlet 744 means at the opposite respective ends thereof. Outlet 744 communicates as with the inlet 746 of intake manifold 26. A venturi section 748, having a venturi throat 750, is provided within the induction passage means 740 generally between the inlet 742 and outlet 744. A secondary main metering fuel discharge nozzle 752, situated generally within the throat 750 of venturi section 748, serves to discharge fuel as is metered by the secondary main metering system, into the induction passage means 740.

Variably openable secondary throttle valve means 754, carried as by a rotatable shaft 756, serves to variably control the discharge and flow of combustible (fuel-air) mixtures into the inlet 746 of intake manifold 26. Suitable throttle control and linkage means, as generally depicted at 758, is provided and operatively connected as to associated actuator means 760. The actuator means 760 may be additional linkage means operatively interconnecting the secondary throttle valve means 754 with the primary throttle valve means 52 so that after such throttle valve means 52 are opened some preselected amount the secondary throttle valve means 754 are thereafter progressively opened, or, the actuator means 760 may be pressure (vacuum) responsive motor means effective for progressively opening the secondary throttle valve means 754 once a preselected minimum rate of air flow through the primary induction passage means 34 is attained. Many specific forms of such secondary actuator means are well known in the art and the practice of the invention is not limited to any specific embodiment of such actuator means 760.

The secondary main fuel metering system comprises passage or conduit means 762 communicating generally between fuel chamber 142 and a generally upwardly extending secondary main fuel well 764 which, as shown, may contain a secondary well tube 766 which, in turn, is provided with a plurality of generally radially directed apertures 768 formed through the wall thereof as to thereby provide for communication as between the interior of the tube 766 and the portion of the well 764 generally radially surrounding the tube 766. Conduit means 770 serves to communicate between the upper part of well 764 and the interior of discharge nozzle 752. Air bleed type passage means 772, comprising conduit means 774 and calibrated restriction or metering means 776, communicates as between a source of filtered air and the upper part of the interior of well tube 766. A secondary main calibrated fuel metering restriction 778 is situated generally upstream of well 764 for example in conduit 762, in order to meter the rate of fuel flow from chamber 142 to secondary main well 764.

Generally, when the engine is running, the intake stroke of each power piston causes air flow through the primary induction passage 34 and venturi throat 48. The air thusly flowing through the venturi throat 48 creates a low pressure commonly referred to as a venturi vacuum. The magnitude of such venturi vacuum is determined primarily by the velocity of the air flowing through the venturi and, of course, such velocity is determined by the speed and power output of the engine. The difference between the pressure in the venturi throat 48 and the air pressure within fuel reservoir chamber 58 causes fuel to flow from fuel chamber 142 through the primary main metering system. That is, the fuel flows through metering restriction 134, conduit means 106, up through well 86 and, after mixing with the air supplied by the main well air bleed means 130, passes through conduit means 64 and discharges from nozzle 50 into induction passage means 34. Generally, the calibration of the various controlling elements are such as to cause such main metered fuel flow to start to occur at some pre-determined differential between fuel reservoir and venturi pressure. Such a differential may exist, for example, at a vehicular speed of 30 m.p.h. at normal road load.

Engine and vehicle operation at conditions less than that required to initiate operation of the primary main metering system are achieved by operation of the idle fuel metering system, which may not only supply metered fuel flow during curb idle engine operation but also at off idle operation.

At curb idle and other relatively low speeds of engine operation, the engine does not cause a sufficient air flow through the venturi throat 48 as to result in a venturi vacuum sufficient to operate the primary main metering system. Because of the relatively almost closed throttle valve means 52, which greatly restricts air flow into the inlet 44 of the intake manifold 26 at idle and low engine speeds, engine or intake manifold vacuum is of a relatively high magnitude. This high manifold vacuum serves to provide a pressure differential which operates the idle fuel metering system.

Generally, the idle fuel system is illustrated as comprising calibrated idle fuel restriction metering means 110 and passage means 100 communicating as between a source of fuel, as within, for example, the fuel well 86, and a generally upwardly extending passage or conduit 96 the lower end of which communicates with a generally laterally extending conduit 98. A downwardly depending conduit 72 communicates at its upper end with conduit 98 while at its lower end it communicates with induction passage means 34 as through aperture means 68. The effective size of discharge aperture 68 may be variably established as by an axially adjustable needle valve member 70 threadably carried by body 32. As generally shown and as generally known in the art, passage 98 may terminate in a relatively vertically elongated discharge opening or aperture 74 located as to be generally juxtaposed to an edge of throttle valve means 52 when such throttle valve 52 is in its curb-idle or nominally closed position. Often, aperture 74 is referred to in the art as being a transfer slot effectively increasing the area for flow of fuel to the underside of throttle valve 52 as the throttle valve is moved toward a more fully opened position.

Conduit means 60, 92, provided with calibrated air metering or restriction means 62, serves to communicate as between an upper portion of conduit 100 and a source of atmospheric air as at the inlet end 36 of induction passage means 34.

At idle engine operation, the greatly reduced pressure area below the throttle valve means 52 causes fuel to flow as from the fuel reservoir 142 and well 86 through conduit means 100 and restriction means 110 and generally intermixes with the bleed air provided by conduit 92 and air bleed restriction means 62. The fuel-air emulsion then is drawn downwardly through conduit 96 and through conduits 98 and 72 ultimately discharged, posterior to throttle valve 52, through the effective opening of aperture 68.

During off-idle operation, the throttle valve means 52 is moved in the opening direction causing the juxtaposed edge of the throttle valve to further effectively open and expose a greater portion of the transfer slot or port means 74 to the manifold vacuum existing posterior to the throttle valve 52. This, of course, causes additional metered idle fuel flow through the transfer port means 74. As the throttle valve means 52 is opened still wider and the engine speed increases, the velocity of air flow through the induction passage 34 increases to the point where the resulting developed venturi 48 vacuum is sufficient to cause the hereinbefore described primary main metering system to be brought into operation.

During the early stage of primary main fuel metering system operation, the secondary throttle valve means 754 remain closed allowing the primary main fuel metering system to provide satisfactory fuel-air ratios and distribution thereof to the engine. However, when engine speed and load increases to a point where additional breathing (air flow) capacity is needed, the secondary throttle valve means 754 start to open by means of the associated actuating or actuator means 760. Generally, as further increases in fuel-air mixtures are needed the secondary throttle valve means 754 are accordingly further opened. During such periods of secondary throttle (operation) opening, the metered fuel supplied to the induction passage means 740 is supplied similarly to that of the primary main metered fuel. That is, the air flow through the secondary induction passage 740 and venturi throat 750 creates a secondary venturi vacuum and the difference between the pressure in the venturi throat 750 and the air pressure within fuel reservoir chamber 142 causes fuel to flow from fuel chamber 142 through the secondary main metering system. That is, the fuel flows through metering restriction 778, conduit means 762, up through well 754 and, after mixing with the air supplied by secondary main well air bleed means 772, passes through conduit means 770 and discharges from nozzle means 752 into induction passage means 740. Generally, the calibration of the various controlling elements are such as to cause such secondary main metered fuel flow to start to occur at some pre-determined differential between fuel reservoir and venturi throat 750 pressure.

The rate of metered fuel flow to the secondary well is enriched or leaned, generally in the same manner as is the rate of metered fuel flow to the primary main fuel metering system, as already described with reference to FIGS. 2 and 7, by the selectively controlled valving means 152. In the embodiment depicted, this may be accomplished as by conduit means 780 communicating as between conduit means 156 and secondary well 764 with such conduit means 780 being preferably provided with calibrated restriction means 782. Of course, such conduit means 780 would not have to extend all the way to the secondary well 764 but could, for example, be placed in communication with conduit means 762 as, also for example, immediately downstream of calibrated restriction means 778. Further, it is also contemplated that no such separate conduit means 780 would be employed but rather conduit means 156 or conduit means 108 could provide a branch conduit portion communicating with conduit 762 downstream of calibrated restriction means 778.

Of course, the operation of the control valve means 152 of FIG. 10 would be as that already described with reference to FIGS. 1–9.

STRUCTURE OF FIG. 11

Figure 11:
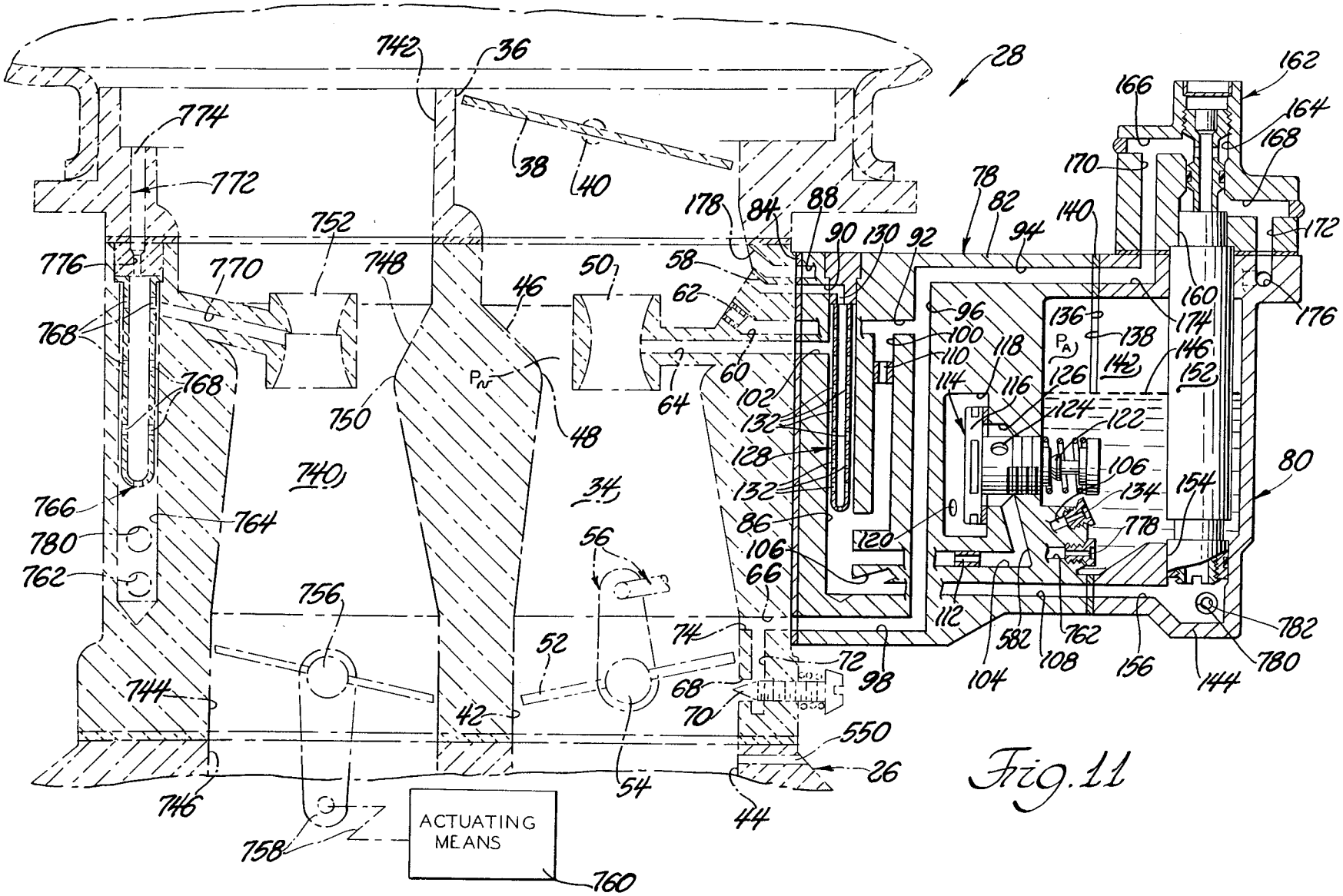
FIG. 11 is a view similar to that of FIG. 10 but illustrating a modification of the invention illustrated in FIG. 10.

FIG. 11 illustrates, as in comparison to FIG. 10, what may be referred to as the "performance" adaptive means or structure employed as with a multi-induction or staged carburetor body means. Generally, all elements which are like or similar to those of FIGS. 1–10 are identified with like reference numbers with the exception that the adaptive means, comprised of portions or sub-assemblies 78 and 80, is identified with reference number "**76*c*" instead of "76*a*" as in FIG. 7**.

The overall operation of the invention as illustrated in FIG. 11 is as that already described with reference to FIG. 10 and, of course, the same modifications as were contemplated in FIG. 10 with respect to conduit means 780, restriction means 782, conduit means 156 and/or conduit means 108, as such apply to conduit 762, are also contemplated in the embodiment of FIG. 11. Further, the adaptive means **76*c* of FIG. 11, as regards the power valve means 114 and associated conduitry distinguishes from that of FIG. 10 in the same manner as does the power valve means 114 and associated conduitry of adaptive means 76*a* distinguish from that of FIG. 2. That is, during maximum engine load conditions with the power valve assembly 114 (FIG. 11) being opened there is effectively no restriction to the rate of fuel flow permitted to flow from metering valving assembly means 152, through conduit means 108, to well 86 other than the metering capacity of metering valving means 152. In such an arrangement it becomes possible to control and shift both the part throttle and wide open throttle curves as generally depicted in FIG. 6 while, in comparison, in the "economy" adaptive means 76*b* of FIG. 10 it is only possible to control the part throttle portions of the curves generally depicted in FIG. 6**.

OTHER EMBODIMENTS

In addition to the embodiments of the invention already herein specifically disclosed and described, it is futher contemplated that the invention can be practiced in the form of other embodiments and/or arrangements. For example, in those situations where the carburetor structure is one having a plurality of induction passage means, operating in a staged manner, and having separate fuel bowls or reservoirs for the respective staged induction passage means, it is contemplated that adaptive means such as that, for example, of FIGS. 2 or 3 could be used to replace each of such separate fuel bowls or reservoirs. Where such a plurality of adaptive means were to be thusly employed, it would be necessary to employ only one circuit control means, as for example, either of FIGS. 4 or 9, and in such event the single illustrated valving means 152 of either FIGS. 4 or 9 would be replaced by a corresponding plurality of valving means 152 in electrically parallel relationship thereby enabling the operator to selectively control the operation of all of such valving means 152 by the single control 71 (FIG. 4) or control 696–698 (FIG. 9).

As should be apparent, each of the embodiments illustrated as well as those not illustrated but nevertheless herein discussed and described, would employ the adaptive means 76, **76*a*, 76*b* or 76*c* along with suitable electrical control circuit means, as for example, in FIGS. 4 or 9, and ultimately placed in combination with vehicle as generally depicted in FIG. 1. However, it should be made clear that the invention, to be practiced, need not employ the computer means 288 and that, instead, only a suitable control 71 or 696–698 could be provided as to be mounted on, for example, the vehicular instrument or dash panel. The operator in such instances would merely rely on his sensory ability to judge whether the adjustments being made are improving the operation of the engine for the then existing operating conditions. It is also contemplated that such control means 71 or 696–698 may be separately mounted in situations where computer means 288 is employed thereby enabling the placement, within the vehicle, of the control means 71 or 696–698 at a location which is more suited for the operator's reach while placing the computer means 288** at a location which is possibly more suited for the operator's line of vision.

Figure 12:
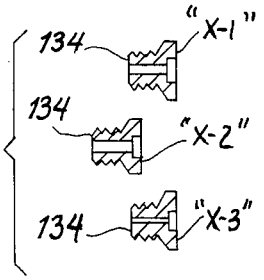
FIG. 12 illustrates, by way of example, a plurality of main fuel restriction means, employable in the kit of the invention.

It is further contemplated that the adaptive means 76, **76*a*, 76*b* and 76*c* (along with the related electrical control circuit means) could, respectively, be sold as kits which could and would be useable on many different models of carburetor structures. For example, a standardized kit of an adaptive means 76 and electrical control circuit means could also include a plurality of main fuel metering restriction means 134, each of a different calibration, along with related instructions to the purchaser of such a kit. The said plurality of main fuel metering restriction means within such a kit, as generally depicted in FIG. 12, could be coded for identification purposes and the related instructions would then tell the purchaser that if the adaptive means so purchased is to be used on an "Ajax Brand" (fictitious name) Model 190 carburetor, the purchaser sould install the main metering restriction means 134 which is coded or identified as (for example) "X-1"; if it is to be used on an "Ajax Brand" Model 500 carburetor, the purchaser should install the main metering restriction means 134 which is coded or identified as (for example) "X-2" and if it is to be used on a "Rascal Brand" (fictitious name) Model 4000 carburetor, the purchaser should install the main metering restriction means which is coded or identified as (for example) "X-3". By so doing, one standard kit could be employable on many different carbureting structures and the plurality of main metering restriction means would then, based on the attendant instructions, enable the purchaser to select the precise main metering restriction means 134 which would result in the main fuel metering system delivering the safest lean fuel-air mixture to the engine under conditions where the fuel valving assembly 152** is not providing additinal metered fuel flow.

It is still further contemplated that, in practicing the invention, the adaptive means 76, *76a*, *76b* and *76c* may be further modified with such modification being in regard to the metering valving assembly 152 and the idle fuel system. That is, more particularly, it is contemplated that the valving assembly 152 could be modified by elimination of the upper portion (FIG. 3) thereof which controls the variable idle air bleed means and elimination of conduit means 94 thereby resulting in an idle fuel metering system which is not effected, in terms of richness of fuel, whenever the main fuel metering system is selectively adjusted for either richer or leaner (in terms of fuel) fuel-air mixtures.

Although only preferred embodiments and modifications of the invention have been disclosed and described, it is apparent that other embodiments and modifications of the invention are possible within the scope of the appended claims.

What is claimed is:

1. A kit assembly for converting an existing carburetor assembly for a vehicular combustion engine to an improved carburetor assembly having an open loop manually adjustable system for selectively controlling the air-fuel ratio supplied to said vehicular combustion engine; wherein said vehicle has ground-engaging drive wheel means, power transmission means for conveying power from the engine to said wheel means, and a source of fuel; wherein said engine is provided with induction passage means of which said first-mentioned carburetor assembly comprises a portion for supplying motive fluid to said engine; wherein said first-mentioned carburetor assembly comprises body means and separable first fuel reservoir means, and wherein said carburetor body means comprises first fuel passage means therein for conveying fuel from said first fuel reservoir means to induction passage means; said kit assembly comprising second fuel reservoir means, said second fuel reservoir means comprising housing means carrying second fuel flow passage means for flowing fuel from said second fuel reservoir means to said first fuel passage means when said first fuel reservoir means is disassembled from said carburetor body means and replaced by said second fuel reservoir means, said first fuel flow passage means and said second fuel flow passage means when operatively connected to each other serving to define carburetor fuel conduit means, a plurality of fuel flow restriction members being calibrated differently from each other so that the rate of fuel flow through one of said restriction members is different from the rate of fuel flow through an other of said restriction members for the same pressure head, wherein a selected one of said plurality of fuel flow restriction members is employed for placing in series flow relationship with said carburetor fuel conduit means, cyclically openable and closeable valving means operatively carried by said second fuel reservoir means, said valving means being in said carburetor fuel conduit means and effective to controllably alter the rate of metered fuel flow through said carburetor fuel conduit means, and manually controlled adjustment means operatively connected to said valving means, said manually controlled adjustment means being effective to selectively control the relative percentage of time that said valving means is opened and the relative percentage of time that said valving means is closed in order to thereby selectively alter the rate of metered fuel flow through said carburetor fuel conduit means and to said engine.

2. A kit assembly according to claim 1 wherein said valving means is effective for metering fuel through said carburetor fuel conduit means to said engine as to attain at least a first fuel-air ratio based on a rate of air flow to said engine, wherein said manually controlled adjustment means comprises electrical adjustment means effective for causing said valving means to meter fuel through said carburetor fuel conduit means to said engine at rates of metered fuel flow which based on said rate of air flow to said engine results in second fuel-air ratios different from said first fuel-air ratio.

3. A kit assembly according to claim 2 wherein said second fuel-air ratios different from said first fuel-air ratio are of a numerical values less than the numerical value of said first fuel-air ratio.

4. A kit assembly according to claim 2 wherein said second fuel-air ratios which are different from said first fuel-air ratio are of numerical values greater than the numerical value of said first fuel-air ratio.

5. A kit assembly according to claim 2 and further comprising override means responsive to an indicium of a preselected condition of engine load for causing said fuel valving means to meter fuel to said engine at a rate of metered fuel flow which when based on the rate of air flow to said engine during said preselected condition of engine load results in a third fuel-air ratio greater than either said first or second fuel-air ratios.

6. A kit assembly according to claim 2 wherein further comprising sensory indicator means for indicating to the engine operator whether said first fuel-air ratio or said second fuel-air ratios are providing a more fuel-efficient fuel-air ratio to said engine.

7. A kit assembly according to claim 2 wherein said air flowing to said engine flows through said induction passage means, wherein said valving means comprises a fuel-flow orifice and valving member and electrically energizable solenoid means, wherein said valving member is operatively connected to said solenoid means, said solenoid means being effective during operation of said engine to oscillatingly move said valving member toward and away from said orifice in order to thereby cause a selected restricting effect on the flow of fuel through said orifice, and wherein said manually selectively controlled electrical adjustment means is effective for selectively varying the relative percentage of time that said valving member is away from said orifice in the overall cycle of oscillation of said solenoid means.

8. A kit assembly according to claim 7 wherein said carburetor fuel conduit means further comprises a second calibrated orifice, and wherein said fuel-flow orifice and said second orifice are in parallel fluid circuit relationship to each other as to have each communicate with said fuel within said second fuel reservoir means.

9. A kit assembly according to claim 2 wherein said air being supplied to said engine flows through said induction passage means, wherein said carburetor fuel conduit means further comprises an idle fuel metering system and a main fuel metering system, said main fuel metering system communicating generally between the fuel in said second fuel reservoir means and said induction passage means, said main fuel metering system comprising a first orifice and cooperating first valve member, electrically energizable solenoid means, said first valve member being operatively connected to said solenoid means, said solenoid means being effective during operation of said engine to oscillatingly move said first valve member toward and away from said first orifice in order to thereby cause a selected restricting effect on the flow of fuel through said first orifice, said idle fuel metering system communicating generally between the fuel in said second fuel reservoir means and said induction passage means, said idle fuel metering system comprising idle fuel conduit means effective for discharging fuel from said fuel in said second fuel reservoir means into said induction passage means, idle fuel inlet means communicating with said idle fuel conduit means and said fuel in said second fuel reservoir means, said idle fuel inlet means comprising second orifice means, air bleed means communicating with said idle fuel conduit means, a second valve member effective for cooperating with said air bleed means to controllably alter the rate of flow of bleed air through said air bleed means and to in response thereto controllably alter the metered rate of fuel flow from said fuel in said second fuel reservoir means through said idle fuel conduit means, said second valve member being operatively connected to said solenoid means as to oscillatingly move with said first valve member whereby when said first valve member is oscillatingly moving toward said first orifice said second valve member is oscillatingly moving away from said air bleed means to more fully open said air bleed means to the flow of bleed air therethrough and whereby when said first valve member is oscillatingly moving away from said first orifice said second valve member is oscillatingly moving toward said air bleed means to more fully close said air bleed means to the flow of bleed air therethrough, and wherein said manually controlled adjustment means is effective for selectively varying the relative percentage of time that said first valve member is away from said first orifice in the overall cycle of oscillation of said solenoid means.

10. A kit assembly according to claim 9 wherein said main fuel metering system further comprises a third orifice, and wherein said first orifice and said third orifice are in parallel fluid circuit relationship to each other as to have each communicate with said fuel in said second fuel reservoir means 11. A kit assembly according to claim 9 wherein said air bleed means comprises first and second air bleed passages communicating with ambient atmosphere, wherein said first air bleed passage is in constant open communication with said ambient atmosphere, and further comprising air bleed orifice means communicating with said second air bleed passage, and wherein said second valve member when oscillatingly being moved moving toward and away from said air bleed orifice means.

12. A kit assembly according to claim 1 wherein said valving means is effective for metering fuel through said carburetor fuel conduit means to said engine as to attain at least a first fuel-air ratio based on the rate of air flow to said engine, wherein said manually controlled adjustment means comprises electrical adjustment means effective for causing said valving means to meter fuel through said carburetor fuel conduit means to said engine in a plurality of rates of metered fuel flows with each of said plurality of rates being different from the others of said plurality of rates and different from the rate of metered fuel flow resulting in said first fuel-air ratio.

13. A kit assembly according to claim 12 and further comprising sensory indicator means for indicating to the engine operator whether said first fuel-air ratio or one of said plurality of rates of metered fuel flows is providing a more fuel-efficient fuel-air ratio to said engine.

14. A kit assembly according to claim 12 and further comprising override means responsive to an indicium of a preselected condition of engine load for causing said fuel valving means to meter fuel to said engine at a rate of metered fuel flow which when based on the rate of air flow to said engine during said preselected condition of engine load results in a third fuel-air ratio of the fuel and air being supplied to said engine which is greater than said first fuel-air ratio or any of fuel-air ratios resulting from said plurality of rates of metered fuel flows.

15. A kit assembly according to claim 13 and further comprising override means responsive to an indicium of a preselected condition of engine load for causing said valving means to meter fuel to said engine at a rate of metered fuel flow which when based on the rate of air flow to said engine during said preselected condition of engine load results in a third fuel-air ratio of the fuel and air being supplied to said engine which is greater than said first fuel-air ratio or any of fuel-air ratios resulting from said plurality of rates of metered fuel flows.

16. A kit assembly according to claim 12 wherein said plurality of rates of metered fuel flows results in a plurality of respective fuel-air ratios of the fuel and air being thereby supplied to said engine, and wherein at least certain of said plurality of respective fuel-air ratios are less than said first fuel-air ratio when supplied to said engine.

17. A kit assembly according to claim 16 and further comprising sensory indicator means for indicating to the engine operator whether said first fuel-air ratio or one of the fuel-air ratios resulting from any of said plurality of rates of metered fuel flows is providing a more fuel-efficient fuel-air ratio to said engine.

18. A kit assembly according to claim 12 wherein said plurality of rates of metered fuel flows results in a plurality of respective fuel-air ratios of the fuel and air being thereby supplied to said engine, and wherein at least certain of said plurality of respective fuel-air ratios are greater than said first fuel-air ratio when supplied to said engine.

19. A kit assembly according to claim 18 and further comprising sensory indicator means for indicating to the engine operator whether said first fuel-air ratio or one of the fuel-air ratios resulting from any of said plurality of rates of metered fuel flows is providing a more fuel-efficient fuel-air ratio to said engine.

20. A kit assembly according to claim 19 and further comprising override means responsive to an indicium of a preselected condition of engine load for causing said fuel valving means to meter fuel to said engine at a rate of metered fuel flow which when based on the rate of air flow to said engine during said preselected condition of engine load results in a third fuel-air ratio of the fuel and air being supplied to said engine which is greater than said first fuel-air ratio or any of fuel-air ratios resulting from said plurality of rates of metered fuel flows.

* * * * *